US011110680B2

(12) United States Patent
Mizutani et al.

(10) Patent No.: US 11,110,680 B2
(45) Date of Patent: Sep. 7, 2021

(54) METHOD OF DETERMINING WARP STATUS FOR CORRUGATED BOARD

(71) Applicant: MITSUBISHI HEAVY INDUSTRIES MACHINERY SYSTEMS, LTD., Hyogo (JP)

(72) Inventors: Hideki Mizutani, Hiroshima (JP); Akira Ogino, Hiroshima (JP)

(73) Assignee: MITSUBISHI HEAVY INDUSTRIES MACHINERY SYSTEMS, LTD., Hyogo (JP)

( * ) Notice: Subject to any disclaimer, the term of this patent is extended or adjusted under 35 U.S.C. 154(b) by 182 days.

(21) Appl. No.: 15/779,527

(22) PCT Filed: Feb. 23, 2016

(86) PCT No.: PCT/JP2016/055213
§ 371 (c)(1),
(2) Date: May 28, 2018

(87) PCT Pub. No.: WO2017/094268
PCT Pub. Date: Jun. 8, 2017

(65) Prior Publication Data

US 2018/0345618 A1 Dec. 6, 2018

(30) Foreign Application Priority Data

Dec. 4, 2015 (JP) ..... JP2015-237678

(51) Int. Cl.
*B31F 1/24* (2006.01)
*B31F 1/28* (2006.01)
(Continued)

(52) U.S. Cl.
CPC ..... *B31F 1/24* (2013.01); *B31F 1/284* (2013.01); *B31F 5/04* (2013.01); *B31F 7/00* (2013.01); *B31F 2201/0784* (2013.01)

(58) Field of Classification Search
None
See application file for complete search history.

(56) References Cited

U.S. PATENT DOCUMENTS

2005/0284579 A1* 12/2005 Ishibuchi ..... B31F 1/284 156/359

FOREIGN PATENT DOCUMENTS

JP H6-82237 A 3/1994
JP 2003-231193 A 8/2003
(Continued)

OTHER PUBLICATIONS

Office Action for Japanese Application No. 2015-237678 dated Jan. 7, 2020; 10pp.

*Primary Examiner* — Barbara J Musser
(74) *Attorney, Agent, or Firm* — Kanesaka Berner & Partners, LLP

(57) ABSTRACT

A warp determination device for a corrugated cardboard sheet manufacturing device is provided with: displacement value measurement method for measuring displacement values of a plurality of corrugated cardboard sheet pieces on the downstream side of a slitter scorer and on the upstream side of a sheet stacking unit; and warp status determination means for dividing a measurement range of the displacement value measurement method according to a width dimension of the plurality of corrugated cardboard sheet pieces, allocating the divided measurement ranges to each of the plurality of corrugated cardboard sheet pieces, and determining a warped status of the corrugated cardboard sheet pieces for each of the plurality of corrugated cardboard sheet pieces on the basis of measurement values from the displacement value measurement method in the allocated measurement ranges.

1 Claim, 14 Drawing Sheets

(51) Int. Cl.
*B31F 5/04* (2006.01)
*B31F 7/00* (2006.01)

(56) References Cited

FOREIGN PATENT DOCUMENTS

| | | | |
|---|---|---|---|
| JP | 3735302 | B2 | 10/2005 |
| JP | H1-86524 | U | 1/2006 |

* cited by examiner

FIG. 8A

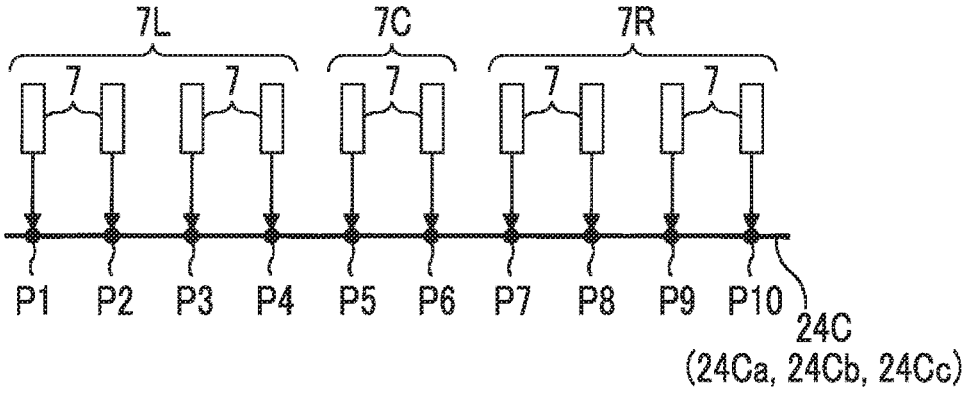

FIG. 8B

| TYPE | WARP SHAPE OF SHINGLING STATUS CORRUGATED FIBERBOARD | INCLINATION OF LEFT STRAIGHT LINE | HEIGHT OF CENTRAL PART TO AVERAGE HEIGHT | INCLINATION OF RIGHT STRAIGHT LINE |
|---|---|---|---|---|
| UPWARD WARP | 24C | FALLING TO RIGHT | LOW | RISING TO RIGHT |
| DOWNWARD WARP | 24C | RISING TO RIGHT | HIGH | FALLING TO RIGHT |
| S-SHAPED WARP | 24C | RISING TO RIGHT | | RISING TO RIGHT |
| | 24C | FALLING TO RIGHT | | FALLING TO RIGHT |
| M-SHAPED WARP | 24C | RISING TO RIGHT | LOW | FALLING TO RIGHT |
| | 24C | FALLING TO RIGHT | HIGH | RISING TO RIGHT |

FIG. 9

| WARP SHAPE OF RESPECTIVE SHINGLING STATUS CORRUGATED FIBERBOARD | PRODUCED SHEET WIDTH WARP SHAPE |
|---|---|
| 24Ca 24Cb 24Cc | UPWARD WARP |
| 24Ca 24Cb 24Cc | DOWNWARD WARP |
| 24Ca 24Cb 24Cc | S-SHAPED WARP |
| 24Ca 24Cb 24Cc | S-SHAPED WARP |
| 24Ca 24Cb 24Cc | M-SHAPED WARP |
| 24Ca 24Cb 24Cc | M-SHAPED WARP |

METHOD OF DETERMINING WARP STATUS FOR CORRUGATED BOARD

RELATED APPLICATIONS

The present application is a National Phase of PCT/JP2016/055213, filed Feb. 23, 2016, and claims priority based on Japanese Patent Application No. 2015-237678, filed Dec. 4, 2015.

TECHNICAL FIELD

The present invention relates to a warp determination device that determines the warp status of a corrugated fiberboard during manufacturing, and a warp correction device and a corrugated fiberboard manufacturing system, using the same determination device.

BACKGROUND ART

A corrugated fiberboard is manufactured by bonding a corrugated medium to one liner (top liner) with glue to make a single-faced corrugated board and further bonding the other liner (bottom liner) to the medium side of the single-faced corrugated board. In this manufacturing process, the respective sheets (the top liner, the bottom liner, the single-faced corrugated board, the corrugated fiberboard) are heated by respective preheaters, such as a top liner preheater, a single-faced corrugated board preheater, and a bottom liner preheater, or a double facer, and, gluing is performed by a single facer or a glue machine. In that case, if neither the amount of heating nor the amount of gluing is proper, a warp may occur in a finished corrugated fiberboard.

As techniques regarding detection of the warp or correction of the warp in the corrugated fiberboard, there are techniques disclosed in PTLs 1 to 3. Although the techniques disclosed in PTLs 1 to 3 will be described below, reference signs used in the respective documents are indicated with parentheses for reference in the description.

In a warp detection device for a corrugated fiberboard disclosed in PTL 1 (refer to lines 5 to 13 of Page 3, FIGS. 1 and 2, and the like), a warp detection device (5) including a plurality of displacement sensors (6) is disposed between a double facer (2) and a slitter scorer (3), and the warp factor [W. F] or a corrugated fiberboard (1) is obtained on the basis of detection results of the warp detection device (5).

In a warp correction system for a corrugated fiberboard disclosed in PTL 2 (refer to Paragraphs [0071] to [0082], FIGS. 14 to 16, and the like), information related to warp of a corrugated fiberboard (25) is acquired by a CCD camera (7) or a displacement sensor (7A) from "the corrugated fiberboard (25) under conveyance by a conveyor (191) of a stacker (19)", or "the corrugated fiberboard (25) stacked on a stacking unit (192) of the stacker (19)", the warp of the corrugated fiberboard is corrected by selecting and controlling a suitable control element out of control elements of a corrugated fiberboard manufacturing device on the basis of this information.

In a corrugated fiberboard manufacturing system disclosed in PTL 3 (refer to Paragraphs [0050] to [0052] and [0080] to [0082], FIG. 11, and the like), information related to warp of a corrugated fiberboard (25) is acquired by a CCD camera (7) or a displacement sensor (7A) from "the corrugated fiberboard under conveyance by a conveyor (191) of a stacker (19)", or "the corrugated fiberboard (25) stacked on a stacking unit (192) of the stacker (19)", and in a case where it is determined that there is no warp of the corrugated fiberboard (25) on the basis of this information, an operational status of the corrugated fiberboard manufacturing device in this case is stored as an optimal operational status in association with a production status. Thereafter, when manufacturing operations are performed in the same production status, control elements of the corrugated fiberboard manufacturing device are automatically adjusted so that this optimal operational status is obtained.

CITATION LIST

Patent Literature

[PTL 1] Microfilm of Japanese Utility Model Registration Application No. S62-181050 (Japanese Unexamined Utility Model Registration Application Publication No. H01-086524)

[PTL 2] Japanese Patent No. 3735302

[PTL 3] Japanese Unexamined Patent Application Publication No. 2003-231193

SUMMARY OF INVENTION

Technical Problem

Meanwhile, when respective sheets are bonded together to manufacture a corrugated fiberboard, it is necessary to make applied raw starch solution permeate into the respective sheets, and then, raise the temperature of this raw starch solution to a gelation temperature to gelate the solution. Adhesion occurs in starch by gelating the raw starch solution.

In order to make the temperature of the raw starch solution applied to the sheets higher than the gelation temperature, the respective sheets are heated during before or after the bonding or during the bonding. However, the sheets shrink due to evaporation of retained moisture when heated. Hence, the respective sheets that constitute the corrugated fiberboard are brought into a shrunk state with little retained moisture until a bonding process is completed (until the sheets pass through the double facer). After passing through the double facer, the sheets absorb moisture in the air as the temperature of the sheets drops, and elongates until the sheets become balanced with the moisture in the air (hereinafter referred to as a moisture equilibrium state).

For this reason, if there is a difference in the amount of the retained moisture between the respective sheets when being bonded together by the double facer, the elongation amounts of the respective sheets are different from each other in the moisture equilibrium state even if there is no warp of the corrugated fiberboard immediately after the bonding. Therefore, a warp may occur in the corrugated fiberboard. On the contrary, even if there is a warp in the corrugated fiberboard immediately after the bonding, the warp may disappear in the corrugated fiberboard in the moisture equilibrium state.

Hence, it is preferable to perform the detection of the warp of the corrugated fiberboard at a position closer to the downstream side in the sheet conveyance direction than the double facer so that the detection can be performed after approaching the moisture equilibrium state.

In the technique disclosed in PTL 1, an installation point of the warp detection device (5) is between the double facer (2) and the slitter scorer (3). Thus, the warp detection is performed at a point relatively near to the double facer (2). For this reason, there is a possibility that the warp detection of the corrugated fiberboard may be performed in a state far from the moisture equilibrium state.

In the respective techniques disclosed in PTL 2 and PTL 3, the warp detection is performed by the conveyor (191) or the stacking unit (192) of the stacker (19). The conveyor (191) and stacking unit (192) of the stacker (19) are separated from the double facer compared to detection points of the technique disclosed in PTL 1. Thus, it is possible to expect the detection of the warp of the corrugated fiberboard in the moisture equilibrium state or in the state near the moisture equilibrium state.

However, the corrugated fiberboard on the conveyor (191) of the stacker (19) and the corrugated fiberboard stacked on the stacker (19) is cut (hereinafter also referred to as slitting) in the sheet conveyance direction by the slitting scorer, and is cut into a plurality of pieces, and is cut (hereinafter also referred to as cutoff) in a sheet width direction by a cutoff device.

In a case where there is a difference between the elongation amount of the single-faced corrugated board and the elongation amount of the bottom liner and in a case where an upward warp occurs if piece cutting is not performed, even if cutting into two pieces is performed, the upward warp occurs in both of corrugated fiberboard one box outs. In a case where the heating of the sheets that constitutes the corrugated fiberboard is uneven with respect to the sheet width direction, for example, a S-shaped warp that is warped upward on one end side in the sheet width direction and is warped downward on the other end side in the sheet width direction occurs, if the piece cutting is not performed. However, in a case where this corrugated fiberboard is slit into halves and cut into two pieces, the upward warp occurs in one corrugated fiberboard one box out, and a downward warp occurs in the other corrugated fiberboard one box out.

That is, if a combination of warps of sheets subjected to the piece cutting is not comprehensively determined in a case where the piece cutting is performed, the type of the warps and therefore the control for solving the warps cannot be performed. However, PTLs 2 and 3 do not describe this point in any way.

In addition, when the warp of the corrugated fiberboard stacked on the stacking unit (192) is detected, this detection result may be fed back to the control of the corrugated fiberboard manufacturing device, and the warp may be corrected late. In the case of a short order (in a case where the order of the corrugated fiberboard is switched in a short period of time), there is a concern that manufacture of the corrugated fiberboard related to the short order may be completed before feedback control is performed.

The present invention has been invented in view of the above problems, and an object thereof is to provide a warp determination device for a corrugated fiberboard manufacturing device, a warp correction device for a corrugated fiberboard manufacturing device, and a corrugated fiberboard manufacturing system that make it possible to determine a warp of a corrugated fiberboard in a state (finished state) where manufacture of the corrugated fiberboard is nearly completed and at an early stage, and to correct the warp precisely and at an early stage on the basis of the warp determination.

Solution to Problem (1) In order to achieve the above object, a warp determination device for a corrugated fiberboard manufacturing device of the invention is a warp determination device for a corrugated fiberboard manufacturing device, which determines warp statuses of a plurality of corrugated fiberboard one box outs, respectively, in the corrugated fiberboard manufacturing device, the corrugated fiberboard manufacturing device longitudinally cutting a corrugated fiberboard web conveyed in a sheet conveyance direction by a slitter scorer to form a plurality of corrugated fiberboard one box outs, transversely cutting the plurality of corrugated fiberboard one box outs in a sheet width direction, respectively, by a cutoff, and then, stacking the plurality of corrugated fiberboard one box outs on a sheet stacking unit of a stacker. The warp determination device includes displacement value measurement method for measuring displacement values of the plurality of corrugated fiberboard one box outs downstream of the slitter scorer in the sheet conveyance direction and upstream of the sheet stacking unit in the sheet conveyance direction; and warp status determination means for dividing a measurement range of the displacement value measurement method according to a width dimension that is a dimension of the plurality of corrugated fiberboard one box outs in the sheet width direction, allocating the divided measurement ranges to the plurality of corrugated fiberboard one box outs, respectively, and determining warp statuses of the corrugated fiberboard one box outs for each of the plurality of corrugated fiberboard one box outs, on the basis of measurement values of the displacement value measurement method in the allocated measurement ranges.

(2) It is preferable that the displacement value measurement method includes a plurality of displacement sensors arranged in the sheet width direction, and the warp status determination means performs the allocation of the measurement ranges by allocating the plurality of displacement sensors to the plurality of corrugated fiberboard one box outs, respectively, according to the width dimension of the plurality of corrugated fiberboard one box outs.

(3) It is preferable that the displacement value measurement method includes imaging means including a plurality of pixels arranged corresponding to the sheet width direction, and image analysis means for analyzing the displacement values of the plurality of corrugated fiberboard one box outs on the basis of information from the imaging means, and the warp status determination means allocates the measurement ranges by allocating the plurality of pixels to the plurality of corrugated fiberboard one box outs, respectively, according to the width dimension of the plurality of corrugated fiberboard one box outs.

(4) it is preferable that the warp status determination means determines a produced sheet width warp shape when it is assumed that the longitudinal cutting is not performed, on the basis of the respective warp statuses in the plurality of corrugated fiberboard one box outs and the arrangement, of the plurality of corrugated fiberboard one box outs.

(5) It is preferable that the stacker includes a stacker conveyor that conveys the plurality of corrugated fiberboard one box outs to the sheet stacking unit, and the displacement value measurement method performs measurement on the corrugated fiberboard one box outs in the midst of being transversely cut by the cutoff and being conveyed by the stacker conveyor.

(6) It is preferable that the respective measurements by the displacement value measurement method are repeatedly performed in a predetermined cycle (periodically at predetermined time intervals), and the warp status determination means performs selection of the measurement values of the displacement value measurement method to be used for determining the warp statuses of the corrugated fiberboard one box outs for the respective corrugated fiberboard one box outs, and the selection is performed for the respective corrugated fiberboard one box outs, using a cycle in which variations of the measurement values of the displacement sensors with respect a previous cycle exceed a threshold value according to a thickness of the corrugated fiberboard one box outs, as a reference.

(7) It is preferable that the corrugated fiberboard web is longitudinally cut into the plurality of corrugated fiberboard one box outs having the same width dimension by the slitter scorer, and the warp status determination means acquires a preset width dimension of the corrugated fiberboard web and a preset piece number of the corrugated fiberboard one box outs, respectively, to obtain the width dimension of the corrugated fiberboard one box outs on the basis of the width dimension of the corrugated fiberboard web and the piece number and determines the measurement ranges allocated to the plurality of corrugated fiberboard one box outs, respectively, on the basis of the width dimension of the corrugated fiberboard one box outs.

(8) It is preferable that the warp status determination means acquires respective preset width dimensions of the plurality of corrugated fiberboard one box outs, and determines the measurement ranges allocated to the plurality of corrugated fiberboard one box outs, respectively, on the basis of the respective width dimensions of the plurality of corrugated fiberboard one box outs.

(9) It is preferable that the warp status determination means does not use the measurement values of the displacement sensors within a predetermined distance from a longitudinal cutting position of the slitter scorer, for the determination of the warp statuses.

(10) It is preferable that each of the plurality of displacement sensors is provided with an adjusting mechanism that changes a position of the displacement sensor in the sheet width direction from a normal position, and the warp status determination means controls the adjusting mechanism so as to separate the displacement sensors, in which the normal position is within a predetermined distance from a longitudinal cutting position of the slitter scorer, by a distance greater than the predetermined distance from the longitudinal cutting position.

(11) It is preferable that the warp status determination means does not use measurement values, which are different by a predetermined value or more from a representative value among the measurement values of the displacement sensors allocated to the same corrugated fiberboard one box outs, for the determination of the warp statuses.

(12) It is preferable that, in a case where the warp statuses of the corrugated fiberboard one box outs are determined to be an upward warp or a downward warp on the basis of the measurement values of the displacement value measurement method, the warp status determination means approximates a shape of the upward warp or the downward warp to a circular-arc shape on the basis of the measurement values of the displacement value measurement method and obtains warp amounts of the corrugated fiberboard one box outs from the shape of the circular-arc shape.

(13) It is preferable that the warp determination device further includes an output device that outputs at least one of the warp shape or the produced sheet width warp shape determined by the warp status determination means.

(14) In order to achieve the above object, a warp correction device for a corrugated fiberboard manufacturing device of the invention is a warp correction device for a corrugated fiberboard manufacturing device including the warp determination device for a corrugated fiberboard manufacturing device according to any one of (4) to (13); and warp correction control means for selecting and controlling a specific control element related to generation of the produced sheet width warp shape out of control elements of a corrugated fiberboard manufacturing device, on the basis of the produced sheet width warp shape determined by the warp determination device.

(15) It is preferable that the corrugated fiberboard manufacturing device bonds a medium and a top liner together by a single facer to create a single-faced corrugated board, and bonds the single-faced corrugated board and a bottom liner by a double facer to create the corrugated fiberboard web, and in a case where the warp correction device further includes sheet temperature measuring means for measuring a sheet temperature on at least one of the medium, the top liner, the single-faced corrugated board, the bottom liner, and the corrugated fiberboard web, the warp correction control means sets a control amount of the specific control element, within a range in which the sheet temperature measured by the sheet temperature measuring means does not fall below than a lower limit temperature set on the basis of a gelation temperature of glue used for the bonding.

(16) It is preferable that the warp correction device further includes a storage that stores operational statuses of the specific control element regarding at the time of warp occurrence of the corrugated fiberboard one box outs and after the control of the specific control element, respectively.

(17) It is preferable to further include operational status information acquisition means for acquiring operational status information on an operational status of the corrugated fiberboard manufacturing device; order information acquisition means for acquiring order information on an order of the corrugated fiberboard manufacturing device; control amount calculation means for calculating control amounts of the respective control elements of the corrugated fiberboard manufacturing device on the basis of the operational status information and the order information; quality information acquisition means for acquiring that the warp amounts of the corrugated fiberboard one box outs are equal to or smaller than a predetermined amount or a warp amount of the corrugated fiberboard web is equal to or smaller than a predetermined amount; optimal operational status information storage means for storing information on a specific control element, which influences a warp status of the corrugated fiberboard web in the operational status information acquired by the operational status information acquisition means, as information on an optimal operational status in an order in a case where the input being performed by the quality information acquisition means, when the quality information acquisition means acquires that the warp amounts of the corrugated fiberboard one box outs are equal to or smaller than the predetermined amount or the warp amount of the corrugated fiberboard web is equal to or smaller than the predetermined amount; and control means for preferentially controlling the specific control element to the optimal operational status in a case where there is information corresponding to a current order in the optimal operational status information stored by the optimal operational status information storage means.

(18) In order to achieve the above object, a corrugated fiberboard manufacturing system of the invention is a corrugated fiberboard manufacturing system including the warp correction device a corrugated fiberboard manufacturing device according to any one of (14) to (17).

Advantageous Effects of Invention

According to the warp determination device for a corrugated fiberboard manufacturing device, the warp correction device for a corrugated fiberboard manufacturing device, and the corrugated fiberboard manufacturing system of the invention, the displacement of the corrugated fiberboard one box outs is detected downstream of the slitter scorer and upstream of the sheet stacking unit of the stacker. Thus, the warp statuses of the respective corrugated fiberboard one box outs can be determined using the measurement values in a state where the corrugated fiberboard passes through the double facer and approaches the moisture equilibrium state, that is, a corrugated fiberboard production completed state (finished state).

Moreover, since the displacement of the corrugated fiberboard one box outs is measured upstream of the sheet stacking unit and the warp statuses are determined, the displacement of the corrugated fiberboard one box outs stacked on the sheet stacking unit can be measured, and can be fed back to the correction of the warp at an earlier stage than determining the warp statuses.

Hence, the determination of the warp statuses of the corrugated fiberboards can be determined in a corrugated fiberboard production completed state (finished state) and at an early stage, and the correction of the warp can be rapidly performed on the basis of this determination.

BRIEF DESCRIPTION OF DRAWINGS

FIGS. 8A and 8B are schematic views for explaining a warp shape determination method related to the first embodiment of the invention, FIG. 8A is a view illustrating a positional relationship between a shingling status corrugated fiberboard and the displacement sensors, and FIG. 8B is a view illustrating a correspondence relationship between measurement values of the displacement sensors and the warp shapes of the shingling status corrugated fiberboards.

FIG. 9 is a schematic view for explaining a method of determining a produced sheet width warp shape related to the first embodiment of the invention, and is a view illustrating a correspondence relationship between the warp shapes of the respective shingling status corrugated fiberboards, and produced sheet width warp shapes.

FIG. 11A is a plan view illustrating the shingling status corrugated fiberboards conveyed on the stacker conveyor, and FIG. 11B is a plan view illustrating a corrugated fiberboard web before being longitudinally cut.

FIG. 14A is a view illustrating an example of an image (acquired image information) captured by an area sensor, and FIG. 14B is a view illustrating an example of displacement value information on the corrugated fiberboards obtained from the image information of FIG. 14A.

DESCRIPTION OF EMBODIMENTS

Hereinafter, respective embodiments of the invention will be described with reference to the drawings.

In the following description, a direction in which various sheet materials (a top liner, a medium, a bottom liner, a single-faced corrugated board, a corrugated fiberboard web, and corrugated fiberboard one box outs) to be handled in the manufacture of a corrugated fiberboard are conveyed is referred to a sheet conveyance direction. Additionally, a horizontal direction orthogonal to the sheet conveyance direction is referred to as a sheet width direction.

Also, cutting a sheet material in the sheet conveyance direction is referred to as longitudinal cutting, and to cutting a sheet material in the sheet width direction is referred to as to transverse cutting.

Additionally, a case where upstream is described without any special description means upstream in the sheet conveyance direction, and similarly, a case where downstream is described without any special description means downstream in the sheet conveyance direction.

Additionally, in a case where there is no special description, warp of a corrugated fiberboard means warp with respect the sheet width direction.

The embodiments shown below are merely exemplary, and there is no intention to exclude various modifications and applications of techniques that are not explicitly described in the following respective embodiments. Respective components of the following respective embodiments can be variously modified and implemented without departing from the concept thereof, can be selected if necessary or can be appropriately combined together.

1. First Embodiment

[1-1. Overall Configuration of Corrugated Fiberboard Manufacturing System]

Figure 1:
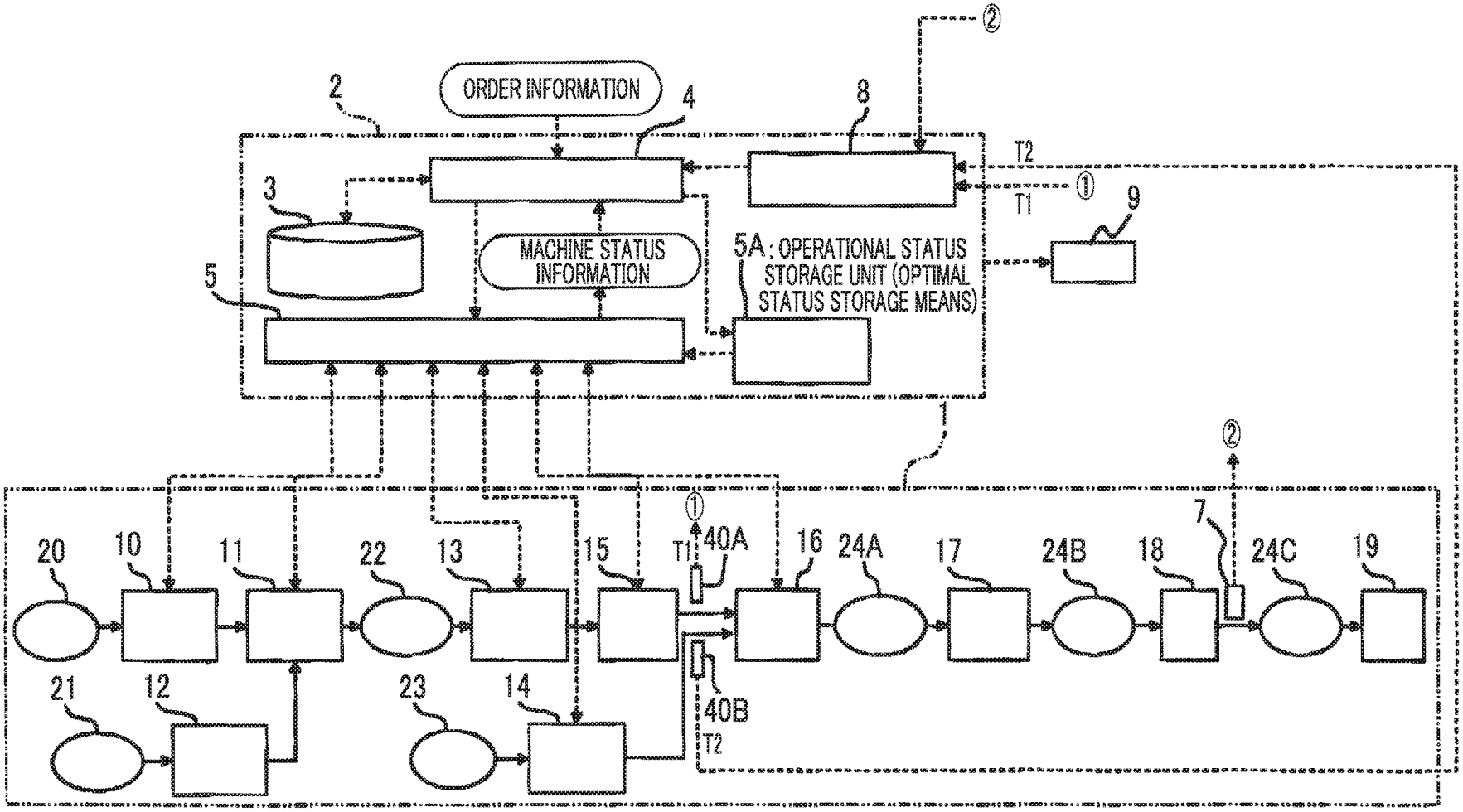
FIG. 1 is a schematic view illustrating an overall configuration of a corrugated fiberboard manufacturing system related to a first embodiment of the invention.

FIG. 1 is a schematic view illustrating an overall configuration of a corrugated fiberboard manufacturing system related to a first embodiment of the invention.

The corrugated fiberboard manufacturing system related to the present embodiment is constituted of a corrugated fiberboard manufacturing device 1 and a Production management device 2 that controls the corrugated fiberboard manufacturing device 1.

The corrugated fiberboard manufacturing device 1 includes, as main constituent devices, top liner preheater 10 that heats a top liner 20, a medium preheater that heats a medium 21, a single facer 11 that corrugates and glues the medium 21 heated by the medium preheater 12 and bonding the top liner 20 heated by the top liner preheater 10 to the medium 21, a single-faced corrugated board preheater 13 that heats a single-faced corrugated board 22 formed by the single facer 11, a bottom liner preheater 14 that heats a bottom liner 23, a glue machine 15 that glues the single-faced corrugated board 22 heated by the single-faced corrugated board preheater 13, a double facer 16 that bonds the bottom liner 23 heated by the bottom liner preheater 14 to the single-faced corrugated board 22 glued by the glue machine 15 to create a corrugated fiberboard web 24A, a slitter scorer 17 that performs longitudinal cutting and ruling on the corrugated fiberboard web created 24A by the double facer 16 to create a plurality of web-shaped corrugated fiberboard one box outs 24B, a cutoff 18 that transversely cuts the plurality of web-shaped corrugated fiberboard one box outs 24B created by the slitter scorer 17 to make shingling status corrugated fiberboards 24C (hereinafter also referred to as shingling status corrugated fiberboard one box outs) that are divided shingling status end products, and a stacker 19 that stacks the shingling status corrugated fiberboards 24C in finished order.

Here, the corrugated fiberboard one box outs in the invention mean those obtained by longitudinally cutting the corrugated fiberboard web 24A (that is, those obtained by longitudinally dividing one corrugated fiberboard web 24A) by the slitter scorer 17, and include both the web shaped corrugated fiberboard one box outs 24B and the shingling status corrugated fiberboard one box outs 24C.

Additionally the corrugated fiberboard manufacturing device 1 may be provided with temperature sensors (sheet temperature measuring means) that measure the temperatures of the respective sheets 20, 21, 22, 23, 24A, 24B, and 24C (in FIG. 1, only a temperature sensor 40A that measures the temperature of the single-faced corrugated board 22, and a temperature sensor 40B that measures the temperature of the bottom liner 23 are illustrated, and the others are omitted).

In addition, in the following description, in a case where the corrugated fiberboard web 24A, the corrugated fiberboard one box outs 24B, and the shingling status corrugated fiberboards 24C are not distinguished from each other, these are written as the corrugated fiberboards 24.

[1-2. Configuration of Main Devices]

A device influencing the moisture content of the top liner 20 and a device influencing the moisture content of the bottom liner 23, among these constituent devices, are devices related to the warp of the corrugated fiberboards 24 in the sheet width direction, and correspond to, for example, the top liner preheater 10, the medium preheater 12, the single-faced corrugated board preheater 13, the bottom liner preheater 14, the single facer 11, the glue machine 15, and the double facer 16.

Additionally, in the present embodiment, as will be described below, a plurality of displacement sensors 7 used for determination (and therefore correction of the warp) of the warp of the corrugated fiberboards 24 are disposed on a stacker conveyor 191B (refer to FIG. 5) of the stacker 19.

Hereinafter, the detailed configuration of these constituent devices 10 to 16, and 19 will be described with reference to FIGS. 2 to 5.

Figure 2:
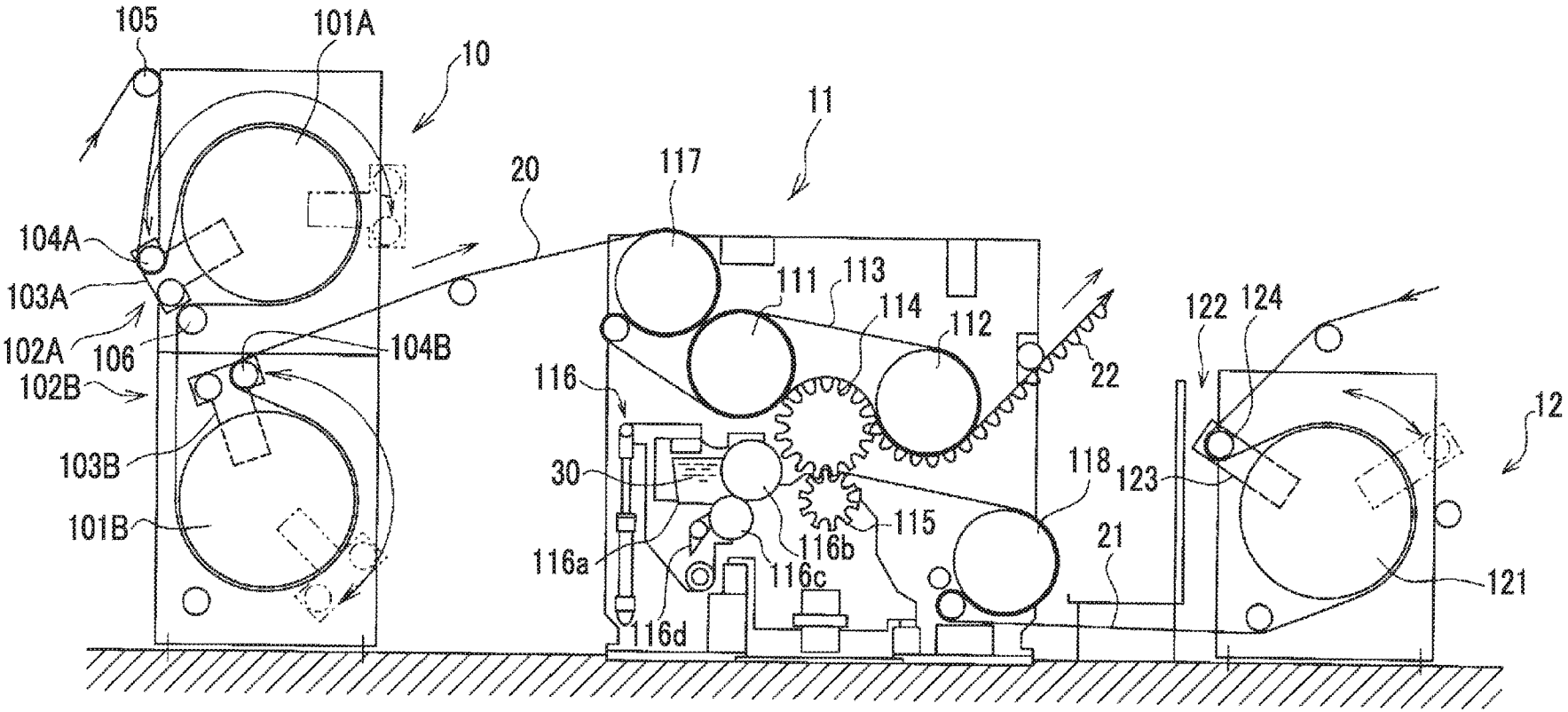
FIG. 2 is a schematic view illustrating the configuration of a top liner preheater, a single facer, and a medium preheater related to the first embodiment of the invention.
Figure 3:
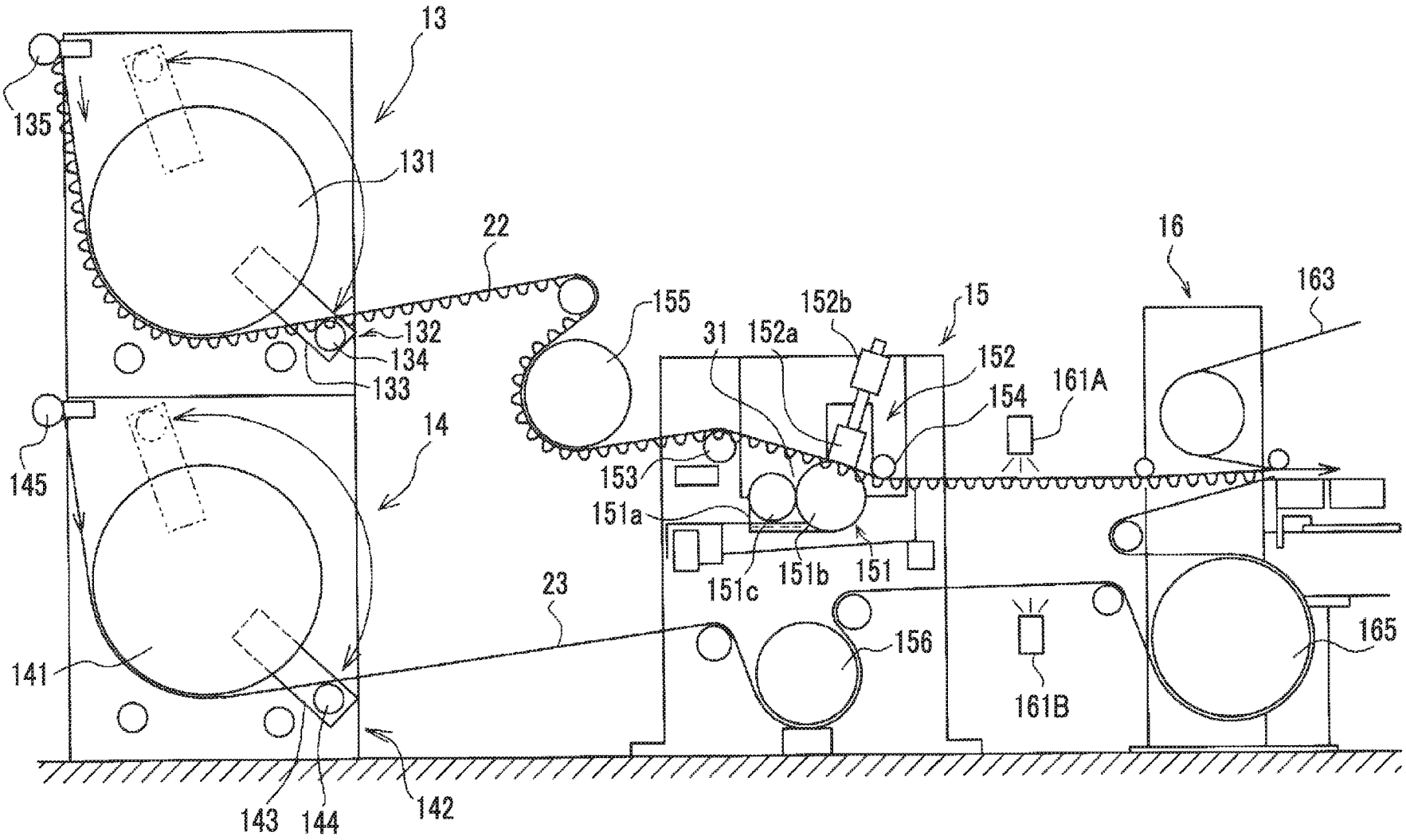
FIG. 3 is a schematic view illustrating a partial configuration of a single-faced corrugated board preheater, a bottom liner preheater, a glue machine, and a double facer related to the first embodiment of the invention.
Figure 4:
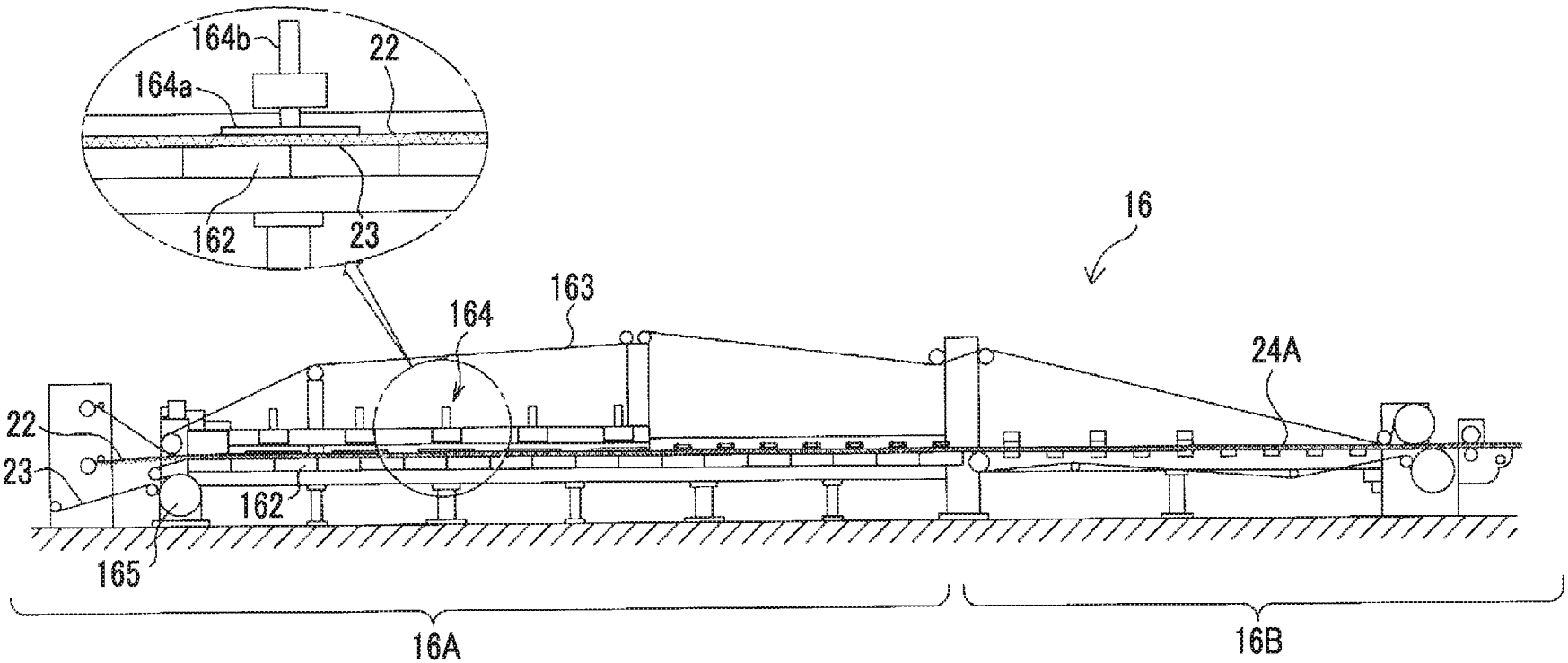
FIG. 4 is a schematic view illustrating the configuration of the double facer related to the first embodiment of the invention.
Figure 5:
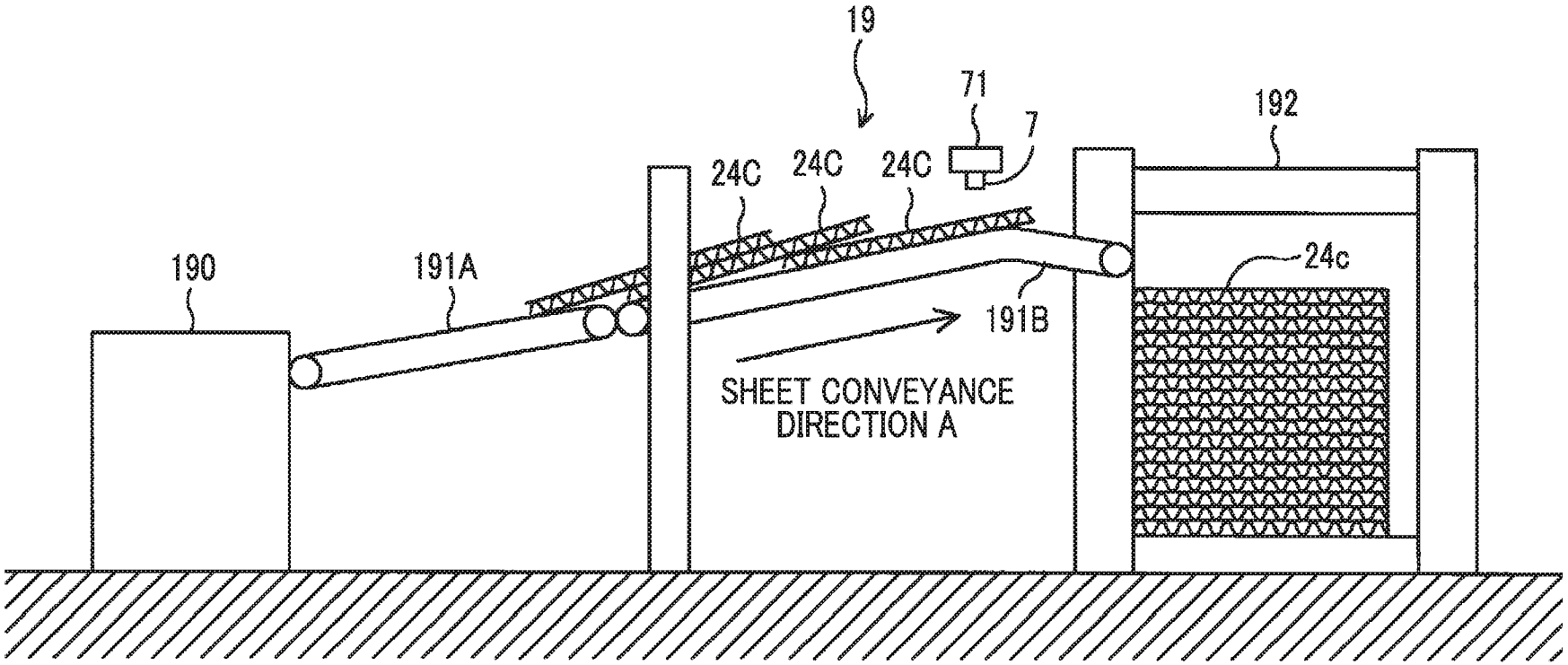
FIG. 5 is a schematic view illustrating the configuration of a stacker related to the first embodiment of the invention.

FIG. 2 is a schematic view illustrating the configuration of the top liner preheater 10, the single facer 11, and the medium preheater 12, FIG. 3 is schematic view illustrating a partial configuration of the single-faced corrugated board preheater 13, the bottom liner preheater 14, the glue machine 15, and the double facer 16, FIG. 4 is a schematic view illustrating the configuration of the double facer 16, and FIG. 5 is a schematic view illustrating the configuration of the stacker 19.

[1-2-1. Configuration of Top Liner Preheater]

As illustrated in FIG. 2, the top liner preheater 10 includes top liner heating rolls 101A and 101B that are disposed vertically in two stages here. The top liner heating rolls 101A and 101B are heated to a predetermined temperature by supplying steam thereinto. The top liner 20 guided in order by guide rollers 105, 104A, 106, and 104B is wound around peripheral surfaces of the top liner heating rolls 101A and 101B, and the top liner 20 is preheated by the top liner heating rolls 101A and 101B.

The guide roller 104A provided in close proximity to one top liner heating roll 101A among the guide rollers 105, 104A, 106, and 104B is supported by a tip of an arm 103A rockably attached to a shaft of the top liner heating roll 101A, and the guide roller 104B provided in close proximity to the other top liner heating roll 101B is supported by a tip of the arm 103B rockably attached to a shaft of the top liner heating roll 101B. Each of the arms 103A and 103B is adapted to be movable to arbitrary positions within an angle range indicated by an arrow in the drawing by a motor (not illustrated). Here, the guide roller 104A, the arm 103A, the motor (not illustrated) and the guide roller 104B, the arm 103B, and the motor (not illustrated) constitute the winding amount adjusting devices 102A and 102B, respectively.

By virtue of such a configuration, in the top liner preheater 10, the moisture content of the top liner 20 is capable of being adjusted depending on steam pressures supplied to the top liner heating rolls 101A and 101B or changes in the winding amounts (winding angles) of the top liner 20 around the top liner heating rolls 101A and 101B by the winding amount adjusting devices 102A and 102B. Specifically, as the steam pressures are higher and the winding amounts are larger, the amounts of heating given from the top liner heating rolls 101A and 101B to the top liner 20 increases, dryness of the top liner 20 proceeds, and the moisture content decreases.

[1-2-2. Configuration of Single Facer]

As illustrated in FIG. 2, the single facer 11 includes a pressurizing belt 113 wound around a belt roll 111 and a tension roll 112, an upper corrugating roll 114 that has a surface formed in a wave shape and abuts against the pressurizing belt 113 in a pressurized state, and a lower corrugating roll 115 that similarly has a surface formed in a wave shape and meshes with the upper corrugating roll 114. The top liner 20 heated by the top liner preheater 10 is wound around a liner-preheating roll 117 and preheated on the way, and then is guided by the belt roll 111 and transferred to a nip part between the pressurizing belt 113 and the upper corrugating roll 114 together with the pressurizing belt 113. Meanwhile, the medium 21 heated by the medium preheater 12 is wound around a medium-preheating roll 118, preheated, and corrugated at a meshing part between the upper corrugating roll 114 and the lower corrugating roll 115, on the way, and then, is guided by the upper corrugating roll 114 and transferred to the nip part between the pressurizing belt 113 and the upper corrugating roll 114.

A cluing device 116 is disposed in the vicinity of the upper corrugating roll 114. The gluing device 116 is constituted of an glue dam 116*a* that stores glue 30, an glue roll 116*b* for applying the glue on the medium 21 conveyed by the upper corrugating roll 114, a meter roll 116*c* that adjusts the adhesion amount of the glue 30 to a peripheral surface of the glue roll 116*b*, and an glue scraping blade 116*d* that scrapes the glue from the meter roll 116*c*. The medium 21 corrugated at the meshing part between the upper corrugating roll 114 and the lower corrugating roll 115 is glued by the glue roll 116*b* at respective top parts of corrugations thereof, and is bonded to the top liner 20 at the nip part between the pressurizing belt 113 and the upper corrugating roll 114. Accordingly, the single-faced corrugated board 22 is formed.

By virtue of such a configuration, the single facer 11 is adapted to be capable of adjusting the moisture content of the top liner 20 depending on a change in a gap amount between the glue roll 116*b* and the meter roll 116*c*. Specifically, as the gap amount is larger, a glue amount on a bonding surface between the medium 21 and the top liner 20 increases, and the moisture content of the top liner 20 increases due to the moisture included in the glue. The above gap amount can be adjusted by moving the meter roll 116*c* with respect to the glue roll 116*b*.

[1-2-3. Configuration of Medium Preheater]

The medium preheater 12 has the same configuration (however, here, a heating roll 121 is provided in only one stage) as the top liner preheater 10, and as illustrated in FIG. 2, includes the medium heating roll 121 heated to a predetermined temperature by supplying steam thereinto, and a winding amount adjusting device 122 that adjusts the winding amount (winding angle) of the medium 21 to the medium heating roll 121. The winding amount adjusting device 122 is constituted of a guide roller 124 around which the medium 21 is wound, an arm 123 that is rockably attached to a shaft of the medium heating roll 121 and supports the guide roller 124, and a motor (not illustrated) that rotates the arm 123.

[1-2-3. Configuration of Single-Faced Corrugated Board Preheater and Bottom Liner Preheater]

The single-faced corrugated board preheater 13 and the bottom liner preheater 14 are disposed vertically in two stages here, as illustrated in FIG. 3. The preheaters 13 and 14 have the same configuration as the aforementioned top liner preheater 10. The single-faced corrugated board preheater 13 includes a single-faced corrugated board heating roll 131 and a winding amount adjusting device 132. The single-faced corrugated board heating roll 131 is heated to a predetermined temperature by supplying steam thereinto. The top liner 20 side of the single-faced corrugated board 22 guided in order by the guide rollers 135 and 134 is wound around a peripheral surface of the single-faced corrugated board heating roll 131, and the top liner 20 side of the single-faced corrugated board 22 is preheated by the single-faced corrugated board heating roll 131.

The winding amount adjusting device 132 is constituted of the one guide roller 134, an arm 133 that is rockably attached to a shaft of the single-faced corrugated board heating roll 131 and supports the guide roller 134, and a motor (not illustrated) that rotates the arm 133. Also, the guide roller 134 is moved to an arbitrary position within an angle range illustrated by an arrow in the drawing by control of the motor so as to be capable of adjusting the winding amount (winding angle) of the single-faced corrugated board 22 to the single-faced corrugated board heating roll 131.

By virtue of such a configuration, the single-faced corrugated board preheater 13 is adapted to be capable of adjusting the moisture content of the top liner 20 depending on a change in a steam pressure supplied to the single-faced corrugated board heating roll 131 or the winding amount (winding angle) of the single-faced corrugated board 22 to the single-faced corrugated board heating roll 131. Specifically, as the steam pressure is higher and the winding amount is larger, the amount of heating applied from the single-faced corrugated board heating roll 131 to the top liner 20 increases, dryness of the top liner 20 proceeds, and the moisture content decreases.

The bottom liner preheater 14 includes a bottom liner heating roll 141 and a winding amount adjusting device 142. The bottom liner heating roll 141 is heated to a predetermined temperature by supplying steam thereinto. A bottom liner 23 guided in order by guide rollers 145 and 144 is wound around a peripheral surface of the bottom liner heating roll 141, and the bottom liner 23 is preheated by the bottom liner heating roll 141.

The winding amount adjusting device 142 is constituted of the one guide roller 144, an arm 143 that is rockably attached to a shaft of the bottom liner heating roll 141 and supports the guide roller 143, and a motor (not illustrated) that rotates the arm 144. Also, the guide roller 144 is moved to an arbitrary position within an angle range illustrated by an arrow in the drawing by control of the motor so as to be capable of adjusting the winding amount (winding angle) of the bottom liner 23 to the bottom liner heating roll 141.

By virtue of such a configuration, the bottom liner preheater 14 is adapted to be capable of adjusting the moisture content of the bottom liner 23 depending on a change in a steam pressure supplied to the bottom liner heating roll 141 or the winding amount (winding angle) of the bottom liner 23 to the bottom liner heating roll 141. Specifically, as the steam pressure is higher and the winding amount is larger, the amount of heating applied from the bottom liner heating roll 141 to the bottom liner 23 increases, dryness of the bottom liner 23 proceeds, and the moisture content decreases.

[1-2-4. Configuration of Glue Machine]

As illustrated in FIG. 3, the glue machine 15 includes a gluing device 151 and a pressurizing bar device 152. The single-faced corrugated board 22 heated by the single-faced corrugated board preheater 13 is preheated by a preheating roll 155 for a single-faced corrugated board on the way, and then, are guided in order by guide rollers 153 and 154 within the glue machine 15. The gluing device 151 is disposed below (medium 21 side) a traveling line of the single-faced corrugated board 22 between the guide rollers 153 and 154, and the pressurizing bar device 152 is disposed above (top liner 20 side) the traveling line.

The gluing device 151 is constituted of a glue dam 151*a* that stores glue 31, a glue roll 151*b* disposed in the vicinity of the traveling line of the single-faced corrugated board 22, and a doctor roll 151*c* that rotates in the same direction the glue roll 151*b* in contact with the glue roll 151*b*. Meanwhile, the pressurizing bar device 152 is constituted of a pressurizing bar 152*a* disposed so as to sandwich the single-faced corrugated board 22 between the pressurizing bar 152*a* and the glue roll 151*b*, and an actuator 152*b* that presses the pressurizing bar 152*a* against the glue roll 151*b* side. The single-faced corrugated board 22 is pressed against the glue roll 151*b* side by the pressurizing bar 152*a*, and is glued at the respective top parts of the corrugations of the medium 21 by the glue roll 151*b* when passing between the pressurizing bar 152*a* and the glue roll 151*b*. The single-faced corrugated board 22 glued on the medium 21 is bonded to the bottom liner 23 by the double facer 16 of the next step.

By virtue of such a configuration, the glue machine is adapted to be capable of adjusting the moisture content of the bottom liner 23 depending on a change in a gap amount between the glue roll 151*b* and the doctor roll 151*c*. Specifically, as the gap amount is larger, a glue amount on a bonding surface between the medium 21 and the bottom liner 23 increases, and thereby the moisture applied to the bottom liner 23 increases and thus the moisture content of the bottom liner 23 increases. The above gap amount can be adjusted by performing positional adjustment of the doctor roll 151*c* with respect to the glue roll 151*b*.

The single-faced corrugated board 22 glued by the glue machine 15 is transferred to the double facer 16 of the next step. Additionally, the bottom liner 23 heated by the bottom liner preheater 14 is also transferred to the double facer 16 through the glue machine 15. In that case, the bottom liner 23 is preheated from a liner-preheating roll 156 while being guided by the liner-preheating roll 156 disposed within the glue machine 15.

At an inlet of the double facer 16, a first shower device (top liner wetting device) 161A is disposed on the top liner 20 side along a traveling line of the single-faced corrugated board 22, and a second shower device (bottom liner wetting device) 161B is disposed along a traveling line of the bottom liner 23. The shower devices 161A and 161B are for adjusting the moisture contents of the top liner 20 and the bottom liner 23, and injects water toward the top liner 20 from the shower device 161A and toward the bottom liner 23 from the shower device 161B. Also, the moisture content of the top liner 20 increases according to the showering amount from the shower device 161A, and the moisture content of the bottom liner 23 increases according to the showering amount from the shower device 161B. In addition, the shower devices 161A and 161B are controlled independently from each other.

[1-2-5. Configuration of Double Facer]

As illustrated in FIG. 4, the double facer 16 is divided into the upstream heating section 16A and the downstream cooling section 16B along a traveling line of the single-faced corrugated board 22 and the bottom liner 23. A plurality of hot plates 162 are disposed at the heating section 162 out of these sections such that the bottom liner 23 passes above the hot plates 162. The hot plates 162 are heated to a predetermined temperature by supplying steam thereinto.

Additionally, a loop-shaped pressurizing belt 163 is traveling in synchronization with the single-faced corrugated board 22 and the bottom liner 23 on the hot plates 162 with the above traveling line interposed therebetween, and is disposed within the loop of the pressurizing belt 163 such that a plurality of pressurizing units 164 face the hot plates 162. Each of the pressurizing units 164 is constituted of a pressurizing bar 164*a* that comes into sliding contact with a back surface of the pressurizing belt 163, and an actuator 164*b* that presses the pressurizing bar 164*a* against the hot plate 162 side.

The single-faced corrugated board 22 glued by the glue machine 15 is carried in between the pressurizing belt 163 and the hot plates 162 from the pressurizing belt 163 side. Meanwhile, the bottom liner 23 heated by the bottom liner preheater 14 preheated by an inlet preheating roll 165 for a liner, and then, is carried in between the pressurizing belt 163 and the hot plates 162 from the hot plate 162 side. Also, the single-faced corrugated board 22 and the bottom liner 23 are carried in between the pressurizing belt 163 and the hot plates 162, respectively, and then, are transferred toward the cooling section 16B in a vertically overlapped state. During this transfer, the single-faced corrugated board 22 and the bottom liner 23 are heated from the bottom liner 23 side while being pressurized via the pressurizing belt 163 by the pressurizing units 164, and thereby, are bonded to each other to become the corrugated fiberboard web 24A. The corrugated fiberboard web 24A is transferred to the slitter scorer 17 of the next step.

By virtue of such a configuration, the double facer 16 is adapted to be capable of adjusting the moisture content of the bottom liner 23 depending on a change in a steam pressure supplied to the hot plates 162 or a pressurizing force of the pressurizing units 164. Specifically, as the steam pressure is higher and the pressurizing force is greater, the amount of heating applied from the hot plates 162 to the bottom liner 23 increases, dryness of the bottom liner 23 proceeds, and the moisture content decreases. Additionally, the moisture content of the bottom liner 23 can also be adjusted depending on a speed at which the single-faced corrugated board 22 and the bottom liner 23 passes through the double facer 16. In this case, since the time for which the bottom liner 23 is in contact with the hot plates 162 becomes longer as the passage speed is slower, dryness of the bottom liner 23 proceeds and the moisture content decreases.

[1-2-6. Configuration of Stacker]

As illustrated FIG. 5, the stacker 19 is configured such that a defect removal device 190, a stacker conveyor 191A, a stacker conveyor 191B, and a stacking unit (sheet stacking unit) 192 are arranged in this order from the upstream side.

The defect removal device 190 is for cutting and removing a switch ng part between an old order and a new order with a predetermined detect part cutoff length when the order change (for example, a change in the number of cut pieces) of the shingling status corrugated fiberboards 24C that are end products is performed.

Normal shingling status corrugated fiberboards 24C that have passed through the defect removal device 190 are conveyed on the stacker conveyors 191A and 191B, and are sequentially stacked on a stacking unit 192.

If the number (or stack height) of the shingling status corrugated fiberboards 24C stacked on the stacking unit 192 exceeds a prescribed number, the shingling status corrugated fiberboards 24C are taken out from the stacking unit 192. The conveyance speeds of the stacker conveyor 191A and the stacker conveyor 191B are variable, and are usually about 20% of the conveyance speed of the upstream double facer 16. Additionally, whenever the takeout operation of the shingling status corrugated fiberboards 24C is performed, the conveyance speed is reduced compared to a normal speed. For these reasons, on the stacker conveyors 191A and 191B, an upstream (trailing) shingling status corrugated fiberboard 24C (only some shingling status corrugated fiberboards 24C are illustrated in FIG. 5) rides on a downstream (leading) shingling status corrugated fiberboard 24C side, and the shingling status corrugated fiberboards 24C are shingled (stacked in roof tiles).

Additionally, the displacement sensors 7 for determining the warp status of the shin ling status corrugated fiberboards 24C are disposed on the stacker conveyor 191B. The displacement sensors 7 are attached to a frame 71, and the plurality of displacement sensors 7 are provided at the same position in the sheet conveyance direction A (in other words, in a sheet conveyance direction W).

In a case where there is trouble in the stacking unit 192, the stacker conveyors 191A and 191B may be stopped. In this case, however, the operating speed or the conveyance speed of each upstream device is just decreased. Thus, more shingling status corrugated fiberboards 24C are shingled on the stacker conveyors 191A and 191B than during normal operation, and the stacking height of the shingling status corrugated fiberboards 24C on the stacker conveyor 191B also becomes high. Even during such trouble, in order the stacked shingling status corrugated fiberboards 24C not to collide against the displacement sensors 7, the displacement sensors 7 are disposed such that detecting ends becoming lower ends thereof have a height (for example, a position about 400 mm higher than a conveying surface of the stacker conveyor 191B) obtained by adding a margin to the estimated stacking height of the shingling status corrugated fiberboards 24C.

[1-3. Configuration of Production Management Device]

The production management device 2 appropriately controls the respective devices 10, 11, 13 to 16, and the like, and as illustrated in FIG. 1, is configured to include a knowledge database 3, a control amount calculation unit 4, a process controller 5, an operational status storage unit (optimal operational status information storage means) 5A, a warp status determination unit (warp status determination means) 8, and an output device 9. The output device 9 is constituted of a display device or a printer (printing device), and outputs warp status information output from a warp status determination unit 8 to the outside by at least one of image information and character information.

The control amount calculation unit 4 has a function as order information acquisition means of the invention, and is adapted to acquire order information from a higher-level production management system (not illustrated). Also, the control amount calculation unit 4 is adapted to calculate respective control amounts according to this order information and machine status information (operational status information) on the corrugated fiberboard manufacturing device 1 acquired via the process controller 5, and outputs the calculation results to the process controller 5 as control commands. Additionally, the process controller 5 is adapted to control respective control elements on the basis of the control commands from the control amount calculation unit 4. In this way, matrix control is performed by the control amount calculation unit 4 and the process controller 5 on the basis of the order information and the operational status information.

The process controller 5 always ascertains the machine status of the corrugated fiberboard manufacturing device 1, and outputs a current machine status to the control amount calculation unit 4 periodically or according to a request from the control amount calculation unit 4. That is, the process controller 5 functions as control means and operational status information acquisition means related to the invention. In addition, the machine status is respective current values of the operating speed (sheet traveling speed) of the corrugated fiberboard manufacturing device 1, the winding amounts of the corrugated sheet to the respective heating rolls 101A, 101B, 121, 131, and 141, the steam pressures between the respective heating rolls 101A, 101B, 121, 131, and 141, the respective gap amounts between the rolls 116*b* and 114 and between the rolls 116*b* and 116*c* in the single facer 11, the gap amount between the glue roll 151*b* and the doctor roll 151*c* in the glue machine 15, the pressurizing forces of the pressurizing units 164 and the steam pressures of the hot plates 162 in the double facer 16, the showering amounts of the shower devices 161A and 161B, and the like.

In an operational status storage unit 5A, at least one item of the order information and at least one item of the operational status information are respectively selected from those that affect the warp of the corrugated fiberboards, are correlated with each other, and are stored. Here, as the order information, paper width, flute, base paper configuration, base paper basis weight, and the like (that is, information on shingling status corrugated fiberboards to be manufactured or information on a raw material of the shingling status corrugated fiberboards) are stored, and as the operational status information, the double facer speed (the passage speeds of the single-faced corrugated board 22 and the bottom liner 23 on the double facer 16), a single-faced corrugated board preheater winding amount in the single-faced corrugated board preheater 13, a bottom liner preheater winding amount in the bottom liner preheater 14, a top liner preheater winding amount in the top liner preheater 10, a single facer glue gap amount (the gap amount between the glue roll 116*b* and the upper corrugating roll 114 or the gap amount between the glue roll 116*b* and the meter roll 116*c*), a glue machine glue gap amount (the gap amount between the glue roll 151*b* and the doctor roll 151*c*), and a double facer pressurizing force (the pressurizing forces of the pressurizing units 164) are stored as a specific control element that influences the moisture contents of the top liner 20 and the bottom liner 23 and therefore the warp of the corrugated fiberboards.

Also, the above process controller 5 always ascertains the respective order information items as described above, and adapted to retrieve the operational status storage unit 5A as to whether or not there is a data group of which a current order and the order coincide with each other [here, respective coincidences in paper width, flute, base paper configuration, and base paper basis weight (including not only perfect coincidence but also substantial coincidence)], for example, in a case where the order of the corrugated fiberboards is switched.

Also, if a desired data group is found, the process controller 5 is adapted to read the operational status information of this data group as optimal operational status information to control a corresponding control element to be in this optimal operational status. Since this can be considered that the optimal operational status information is taught from the operational status storage unit 5A, this control will be hereinafter referred to as teaching control. Meanwhile, if the optimal operational status information corresponding to the current order is not found is the operational status storage unit 5A, the process controller 5 is adapted to perform normal matrix control.

Additionally, the operational status storage unit 5A also stores an operational status at the time of warp occurrence of the shingling status corrugated fiberboards 24C or after the control of correcting the warp (after the control of the specific control element) in association with the warp status (the warp amount and the warp shape) or the order, in addition to at the time of the optimal operation status.

In the knowledge database 3, with respect to the specific control element that influences the warp of the corrugated fiberboards 24 among the control elements for controlling the corrugated fiberboard manufacturing device 1, a set value of the control amount (an adjustment amount from a current value) of the specific control amount or a set equation for setting a control amount is determined in correspondence with the warp status of each of the corrugated fiberboards 24 and is stored.

For example, in a case where the warp status determination unit 8 to be described below determines that the produced sheet width warp of the corrugated fiberboards 24 is an upward warp with respect to a sheet width direction, the set value or set equation of the control amount of each control element is determined so as to increase the moisture content of the bottom liner 23 or to decrease the moisture content of the top liner 20. On the contrary, in a case where the warp status determination unit 8 to be described below determines that the produced sheet width warp of the corrugated fiberboards 24 is a downward warp (convex toward the top liner 20 side) with respect to the sheet width direction, the set value or set equation of the control amount of each control element is determined so as to increase the moisture content of the top liner 20 or to decrease the moisture content of the bottom liner 23.

Moreover, in the knowledge database 3, the control element (specific control element) to be output with respect to the warp is determined. As the control elements of the present embodiment, there are, for example, a bottom-liner-side preheater winding amount (the winding amount of the bottom liner 23 to the bottom liner heating roll 141), the winding amount of the single-faced corrugated board side preheater (the winding amount of the single-faced corrugated board 22 to the single-faced corrugated board heating roll 131), a single facer top liner side preheater winding amount (the winding amounts of the top liner 20 to the top liner heating rolls 101A and 101B), a single facer medium preheater winding amount of (the winding amount of the medium 21 to the medium heating roll 121), a glue machine gluing amount (the gap amount between the glue roll 151*b* and the doctor roll 151*c*), a single facer gluing amount (the gap amount between the glue roll 116*b* and the upper corrugating roll 114 or the gap amount between the glue roll 116*b* and the meter roll 116*c*), a double facer pressurizing force (the pressurizing forces of the pressurizing units 164), a double facer operating speed, a shower for a medium, a shower for a single-faced corrugated fiberboard, a bottom liner side shower, and a double facer hot plate steam pressure (a steam pressure for each hot plate 162).

In addition, the knowledge database 3 stores the operational status of the specific control element, at the time of the warp occurrence and after the control of the specific control element that influences the warp of the corrugated fiberboards, respectively.

In addition, it is desirable that the control for correcting the above warp is performed within a range in which the temperatures of the respective sheets 20, 21, 22, 23, 24A, 24B, and 24C detected by the temperature sensors do not fall below a reference temperature. This reference temperature is a lower limit temperature set such that the glue applied in order to bond the respective sheets 20, 21, 22, 23, 24A, 24B, and 24C together does not become equal to or lower than a gelation temperature. Additionally, in a case where there is no temperature sensor, it is desirable not to perform the control of lowering the temperatures of the respective sheets 20, 21, 22, 23, 24A, 24B, and 24C in the control for correcting the above warp.

Additionally, in a case where the shape of the produced sheet width warp is other than (S-shaped warp, M-shaped warp, or the like) the upward warp and the downward warp, an alarm is issued, or in a case where the specific control element (for example, the double facer 16 capable of imparting the distribution of pressurizing forces to the hot plates 162 in a sheet width direction W or a shower capable of imparting the distribution of the showering amount to the sheet width direction W) that can perform adjustment of the amount of heating or the moisture content in the sheet width direction W on any of the sheets 20, 21, 23, 24A, 24B, and 24C is provided, the warp is corrected using this.

The control amount calculation unit 4 retrieves the knowledge database 3 on the basis of a determination signal from the warp status determination unit 8. Then, set values or set equations of control amounts of corresponding control elements are read from the knowledge database 3, and the respective control amounts according to the machine status (operational status) of the corrugated fiberboard manufacturing device 1 are calculated.

Additionally, in a case where a reset button (not illustrated) is selected, the control amount calculation unit 4 sends a command to the process controller 5 such that all the control elements are returned to their original values (values determined by the matrix control on the basis of the order information, such as base paper configuration, the basis weight of used base paper, paper width, and flute).

The process controller 5 comprehensively controls the respective devices 10 to 19 that constitute the corrugated fiberboard manufacturing device 1. In a case where the optimal operational status corresponding to the current order is not stored in operational status storage unit 5A, the process controller 5 usually controls the respective devices 10 to 19 by the matrix control on the basis of the order information. However, in a case where the warp status determination unit 8 to be described below determines that the produced sheet width warp has occurred, the correction of the warp is achieved by controlling the specific control element (the single-fared corrugated board preheater winding amount in the single-faced corrugated board preheater 13, the bottom liner preheater winding amount in the bottom liner preheater 14, the top liner preheater winding amount in the top liner preheater 10, or the like) specified by the knowledge database 3 with the control amounts calculated by the control amount calculation unit 4. That is, warp control means of the invention is configured to include the knowledge database 3, the control amount calculation unit 4, and the process controller 5, and a warp correction device for a corrugated fiberboard manufacturing device of the invention is configured to include the knowledge database 3, the control amount calculation unit 4, the process controller 5, and the warp status determination unit 8.

Additionally, the process controller 5 controls the respective devices 10, 13, and 14 so as to return all the control elements to their original values in a case where the above reset button is pushed.

Also, the process controller 5 retrieves the operational status storage unit 5A as to whether or not there is the optimal operational status corresponding to the current order, in a case where an order change is performed, and preferentially adjust a specific predetermined control element to the optimal operational status by the teaching control, in a case where the optimal operational status is found.

[1-4. Warp Status Determination Device]

The warp status determination unit 8 determines warp statuses of the respective corrugated fiberboard one box outs 24C on the basis of detection results of the plurality of displacement sensors 7 that can be set in the midst of the respective shingling status corrugated fiberboards 24C being conveyed by the stacker conveyor 191B. The plurality of displacement sensors 7 constitute displacement value measurement method of the invention, and the warp status determination unit 8 constitutes a warp determination device for a corrugated fiberboard manufacturing device of the invention together with the plurality of displacement sensors 7, that is, the displacement value measurement method.

The warp status determination unit 8 determines the warp shape and the warp amount as the warp status. Additionally, in a case where the warp amount is equal to or less than a predetermined amount, the warp status determination unit 8 outputs the fact to the control amount calculation unit 4. The control amount calculation unit 4 outputs various kinds of order information and various kinds of operational status information in this case to the operational status storage unit 5A as the optimal operational status information, and the operational status storage unit 5A associates these kinds of order information and operational status information with each other to stores the associated information as the data group. That is, the operational status when the warp status determination unit 8 determines that the warp amount is equal to or less than the predetermined amount is stored as the optimal operational status at the time of this order.

Hence, the warp status determination unit 8 constitutes quality information acquisition means of the invention together with the displacement sensors 7.

Hereinafter, the determination of the warp shape and the determination of the warp amount will be described.

[1-4-1. Determination of Warp Shape]

A warp shape determination method by the warp status determination unit 8 that is major feature of the invention will be described with reference to FIGS. 6 to 9.

Figure 6:
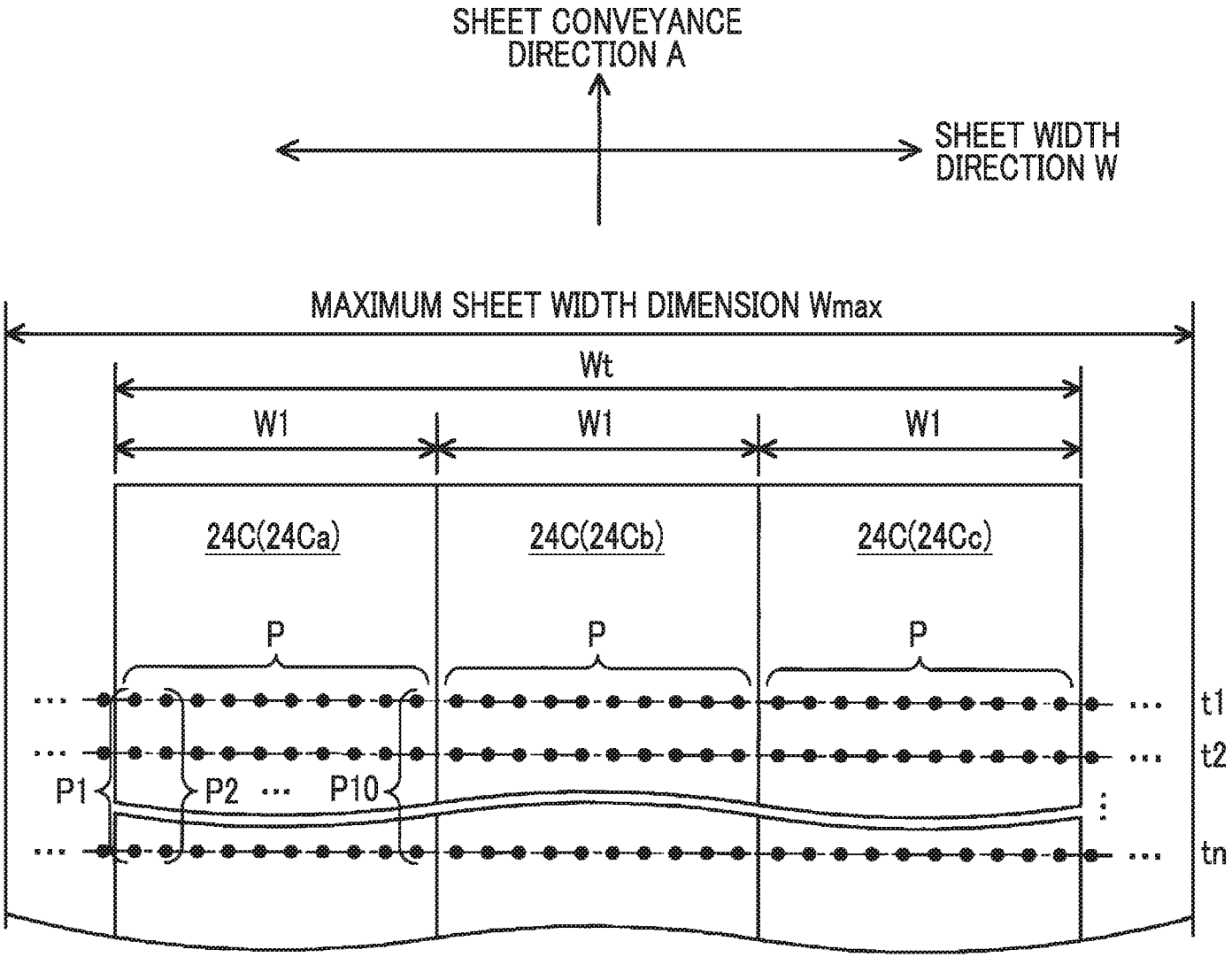
FIG. 6 is a view for explaining warp status determination related to the first embodiment of the invention, and is a schematic plan view of a plurality of shingling status corrugated fiberboards that are conveyed on a stacker conveyor.

FIG. 6 is a view for explaining the warp status determination related to the first embodiment of the invention, and is a schematic plan view of a plurality of shingling status corrugated fiberboards that are conveyed on the stacker conveyor. In addition, FIG. 6 illustrates a case where there is no deviation (variations in leading edge positions is the sheet conveyance direction A) of the shingling status corrugated fiberboards 24C occurring due to shingling to be described below for the sake of convenience.

Figure 7:
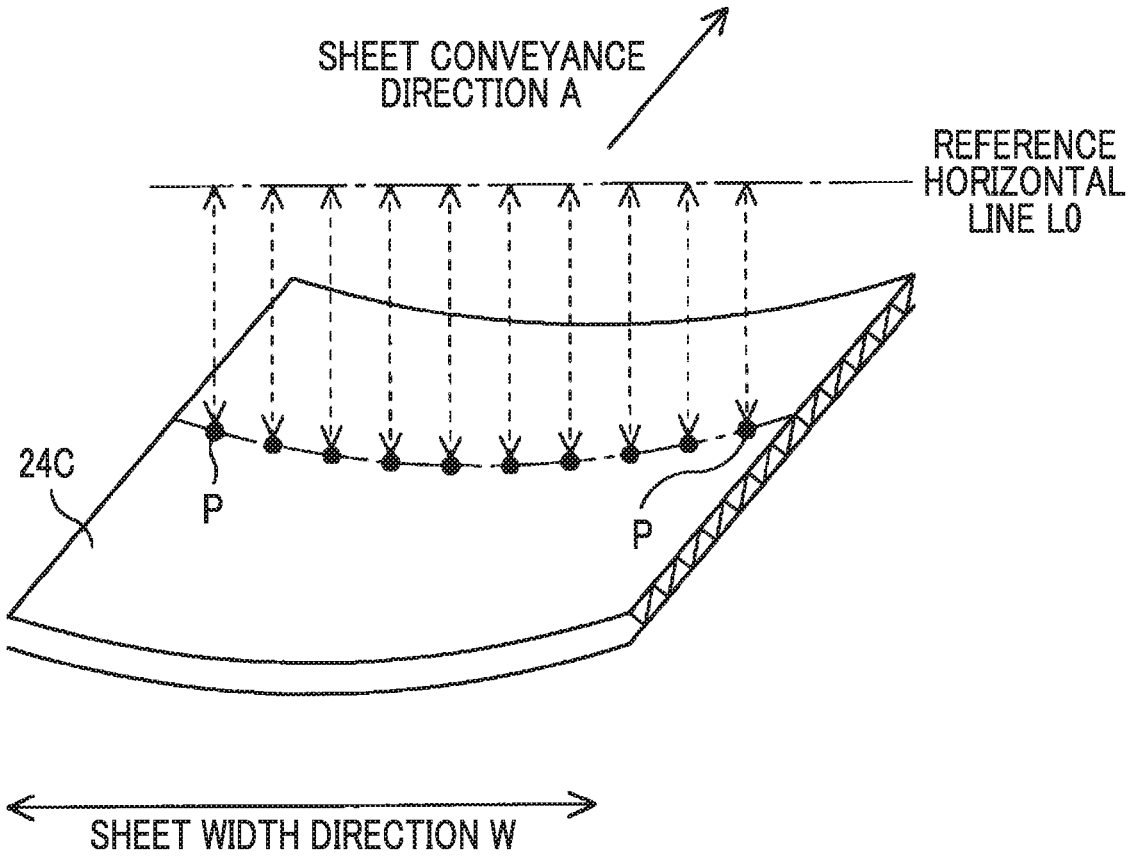
FIG. 7 is a view for explaining displacement sensors related to the first embodiment of the invention, and is a schematic perspective view of a shingling status corrugated fiberboard.

FIG. 7 is a view for explaining the displacement sensors related to the first embodiment of the invention, and is a schematic perspective view of a shingling status corrugated fiberboard.

FIGS. 8A and 8B are schematic views for explaining the warp shape determination method related to the first embodiment of the invention, FIG. 8A is a view illustrating a positional relationship between a shingling status corrugated fiberboard and the displacement sensors, and FIG. 8B is a view illustrating a correspondence relationship between measurement values of the displacement sensors and the warp shapes of the shingling status corrugated fiberboards.

FIG. 9 is a schematic view for explaining a method of determining a produced sheet width warp shape related to the first embodiment, of the invention, and is a view illustrating a correspondence relationship between the warp shapes of the respective shingling status corrugated fiberboards, and produced sheet width warp shapes.

As illustrated in FIG. 6, the warp status determination unit 8 first determines warp shapes in the sheet width direction W regarding the plurality of (in the present embodiment, sheets having the same width dimension (hereinafter also referred to as slit width) W1 is three) shingling status corrugated fiberboards 24C (in the following, especially in a case where these sheets are distinguished from each other, different reference signs 24Ca, 24Cb, and 24Cc are used) arranged in the sheet width direction W, and determines imaginary warp shapes in a case where it is assumed that the corrugated fiberboard web 24A is not longitudinally cut by the slitter scorer 17, on the basis of the warp shapes of the plurality of shingling status corrugated fiberboards 24C. In the invention, the warp shape of a full-width corrugated fiberboard web 24A in a case where it is assumed that the corrugated fiberboard web 24A is not longitudinally cut by the slitter scorer 17 is referred to as a produced sheet width warp shape.

As described above, the determination of the warp shapes of the respective shingling status corrugated fiberboards 24C is performed on the basis of the detection results of the displacement sensors 7 in the midst of the respective shingling status corrugated fiberboards 24C being conveyed by the stacker conveyor 191B.

As illustrated in FIG. 7, the displacement sensors 7 measure vertical displacement values from a reference horizontal line L0 of the shingling status corrugated fiberboard 24C to respective measurement points P (distances illustrated by a dashed-line arrow in FIG. 7) in a vertically downward direction.

In the present embodiment, as illustrated in FIG. 6, the plurality of displacement sensors 7 are disposed at equal intervals over a maximum sheet width dimension Wmax capable of being manufactured in the sheet width direction W by the corrugated fiberboard manufacturing device 1. In the present embodiment, an example in which the corrugated fiberboard web 24A (refer to FIG. 1) having a width dimension (hereinafter referred to as produced sheet width) Wt smaller than the maximum sheet width dimension Wmax is equally divided into three, and three cut shingling status corrugated fiberboards pieces 24C having a width dimension W1 are obtained, respectively, will be described.

The warp status determination unit 8 acquires the produced sheet width Wt as the order information from the production management system, and selects displacement sensors 7 at suitable positions (in other words, vertically upward of the three shingling status corrugated fiberboards 24C) as displacement sensors for warp status determination, out of the displacement sensors 7 disposed over the maximum sheet width dimension Wmax, on the basis of the produced sheet width Wt. Here, thirty central displacement sensors 7 are selected.

Also, since the respective displacement sensors 7 measure the vertical displacement values of the shingling status corrugated fiberboards 24C on the vertically lower side thereof as described above, the measurement points P (illustrated in FIG. 6) of the respective displacement sensors are vertically downward of the displacement sensors 7 (that is, the respective measurement points P are points according to the arrangement of the respective displacement sensors 7. For example, a leftmost measurement point P is located at a measurement point of the displacement sensor 7 disposed on the leftmost side with respect to the sheet conveyance direction A.

That is, regarding the produced sheet width Wt, thirty measurement points P are set at equal intervals in the sheet width direction W. In more detail, the measurement points P are set at the centers of respective width portions obtained by equally dividing the produced sheet width Wt into 30.

Here, the warp status determination unit 8 performs allocation of the displacement sensors 7 to the plurality of shingling status corrugated fiberboards 24C arranged in the sheet width direction W, respectively, according to the width dimension W1 (in other words, allocates a measurement range of displacement value measurement method including the plurality of displacement sensors 7). Specifically, an allocation number Ns of the displacement sensors 7 is determined ($Ns=W1/Wt\times30$) according to the ratio of the width dimension W1 per one shingling status corrugated fiberboard 24C to the produced sheet width Wt, and the arrangement of the displacement sensors 7 to be allocated to the shingling status corrugated fiberboards 24C is determined according to the arrangement of the shingling status corrugated fiberboards 24C.

In the present embodiment, since the width dimensions of the three shingling status corrugated fiberboards 24C are the same, the allocation numbers Ns of the displacement sensors 7 to be allocated to the respective shingling status corrugated fiberboards 24C become ten, respectively. Hence, in FIG. 6, ten displacement sensors 7 near the left are allocated to a left shingling status corrugated fiberboard 24Ca among the thirty displacement sensors 7 corresponding to the produced sheet width Wt, ten central displacement sensors 7 are allocated to a central shingling status corrugated fiberboard 24Cb, and ten displacement sensors 7 near the right are allocated to a right shingling status corrugated fiberboard 24Cc.

In short, the measurement points P are allocated to the shingling status corrugated fiberboard 24Ca with a plurality of displacement sensors 7 located on the shingling status corrugated fiberboard 24Ca as a group, the measurement points P are allocated to the shingling status corrugated fiberboard 24Cb with a plurality of displacement sensors 7 located on the shingling status corrugated fiberboard 24Cb as a group, and the measurement points P are allocated to the shingling status corrugated fiberboard 24Cc with a plurality of displacement sensors 7 located on the shingling status corrugated fiberboard 24Cc as a group.

Additionally, the respective displacement sensors 7 simultaneously perform measurement at each predetermined time interval (hereinafter also referred to as measurement interval) Δt. In other words, measurement is performed on the shingling status corrugated fiberboards 24C at each conveyance distance according to the above measurement interval Δt. In FIG. 6, the measurement points P on a line t1 that is a one-dot chain line indicate the measurement points P at a measurement time t1, and the measurement points P on a line t2 that is a one-dot chain line indicate the measurement points P at the next measurement time t2 (t2=t1+Δt).

In addition, in a case where the width dimensions of the respective shingling status corrugated fiberboards 24C are the same as in the present embodiment, the warp status determination unit 8 acquire information on this fact (the fact that the width dimensions of the respective shingling status corrugated fiberboards 24C are the same, that is, the fact that the corrugated fiberboard web 24A are longitudinally cut equally by the slitter scorer 17) in advance from the production management system. In this case, information on the width dimension (produced sheet width) Wt of the corrugated fiberboard web 24A and piece numbers Nsh of the corrugated fiberboard one box outs 24B and 24C is further acquired from the production management system, and the width dimension W1 per one shingling status corrugated fiberboard 24C is obtained from the width dimension Wt and the piece numbers Nsh (W1=Wt/Nsh).

In the present embodiment, although the width dimensions W1 of the plurality of shingling status corrugated fiberboards 24C are made the same, the width dimensions of the plurality of shingling status corrugated fiberboards 24C may not be the same. In this case, since the warp status determination unit 8 acquires information on the fact that the width dimensions of the respective shingling status corrugated fiberboards 21C are not the same, from the production management system, respective width dimensions of respective corrugated fiberboard webs 24A are further acquired from the production management system, and allocation of the displacement sensors 7 to the respective corrugated fiberboard webs 24A is performed according to these width dimensions.

The warp status determination unit 8 determines respective warp shapes, in the sheet width direction W, of the respective shingling status corrugated fiberboards 24Ca, 24Cb, and 24Cc on the stacker conveyor 191B. The warp status determination unit 8 further determines warp shapes in the sheet width direction W in a case where it is assumed that the corrugated fiberboard webs 24A are not longitudinally cut by the slitter scorer 17, on the basis of these respective warp shapes, in other words, the warp shape (produced sheet width warp shape), in the sheet width direction W, of one corrugated fiberboard web 24A of the produced sheet width Wt in a case where it is assumed that the corrugated fiberboard web 24A (of the produced sheet width Wt) is conveyed on the stacker conveyor 1918.

The warp of shingling status corrugated fiberboards 24Ca, 24Cb, and 24Cc is caused due to the imbalance (the imbalance of the moisture content) of heating of the sheets 20, 21, 22, and 23 in a manufacturing step before the longitudinal cutting by the slitter scorer 17 is performed. For this reason, it is preferable to control the control elements that influence the warp of the corrugated fiberboard manufacturing device as mentioned above on the basis of the produced sheet width warp shapes that are directly influenced by the imbalance (the imbalance of the moisture content) of the heating of the sheets 20, 21, 22, and 23 before the longitudinal cutting is performed. Additionally, the determination of the warp status is performed on the corrugated fiberboards 24 in a state where the moisture equilibrium state is approached as much as possible, as described in the column "Technical Problem".

Thus, the warp status determination unit 8 determines the respective warp shapes, in the sheet width direction W, of the respective shingling status corrugated fiberboards 24Ca, 24Cb, and 24Cc on the stacker conveyor 191B, as described above, and determines imaginary produced sheet width warp shapes in a case where it is assumed that the longitudinal cutting is not performed by the slitter scorer 17 on the basis of these respective warp shapes.

Describing the warp shape determination method by the warp status determination unit 8, the warp status determination unit 8 determines the warp shapes and therefore the produced sheet width warp shapes of the shingling status corrugated fiberboards 24C, respectively, at each measurement interval Δt, as illustrated in FIGS. 8A and 8B, in synchronization with the above-described measurement interval Δt of the displacement sensors 7.

Describing specifically, the warp status determination unit 8 divides the displacement sensors 7 allocated to each shingling status corrugated fiberboard 24C of a slit width W1 into three, as illustrated in FIG. 8A. That is, the displacement sensors 7 are divided into a left sensor group 71 including four displacement sensors 7 near the left as seen in the sheet conveyance direction A (as seen from the rear side), a central sensor group 7C including two central displacement sensors 7, and a right sensor group 7R including four displacement sensors 7 near the right. Additionally, the warp status determination unit 8 acquires measurement values (vertical displacement values) of the displacement sensors 7 at respective measurement points P1 to P10, and calculates an average displacement value d*, and respective displacement values of the measurement points P5 and P6 on the basis of these measurement values.

With measurement values of the displacement sensors 7 at specific measurement points as reference values, the average displacement value d* is an average value of differences (=measurement values−reference values) between the measurement values and the reference values at the respective measurement points, and the warp status determination unit 8 calculates the average displacement value from the measurement values of the displacement sensors 7 at the respective measurement points P1 to P10. In the present embodiment, a measurement value at the leftmost measurement point P1 is used as a reference.

The displacement value of the measurement point P5 is a difference between a measurement value and a reference value of the measurement point P5 (measurement value–reference value of the measurement point P5), and the displacement value of the measurement point P6 is a difference between a measurement value and a reference value of the measurement point P6 (measurement value–reference value of the measurement point P6).

The warp status determination unit 8 obtains inclinations of measurement values of the measurement points P1 to P4 near the left of the shingling status corrugated fiberboard 24C by linear approximation (the linearly approximated inclinations are also hereinafter referred to as "inclinations of left straight lines"), on the basis of the measurement values of the respective displacement sensors 7 of the left sensor group 71. The warp status determination unit 8 obtains inclinations of measurement values of the measurement points P7 to P10 near the right of the shingling status corrugated fiberboard 24C by linear approximation (the linearly approximated inclinations are also hereinafter referred to as "inclinations of right straight lines"), on the basis of the measurement values of the respective displacement sensors 7 of the right sensor group 7R. Moreover, the warp status determination unit 8 determines whether or not displacement values of the central measurement points P5 and P6 of the shingling status corrugated fiberboard 24C are higher or lower than the average displacement value d*, on the basis of the measurement values of the respective displacement sensors 7 of the central sensor group 7C.

Also, as illustrated in FIG. 8B, the warp status determination unit 8 determines that the warp shape of the shingling status corrugated fiberboard 24C is the upward warp, in a case where the inclinations of the left straight lines fall to the right, the displacement values of the measurement points P5 and P6 are larger than the average displacement value d* (in other words, central part heights are lower than an average height), and the inclinations of the right straight lines rise to the right, and determines that the warp shape of the shingling status corrugated fiberboard 24C is the downward warp, in a case where the inclinations of the left straight lines rise to the right, the displacement values of the measurement point P5 and of P6 are smaller than the average displacement value d* (in other words, the central part heights are higher than the average height), and the inclinations of the right straight lines fall to the right.

Addtionally, the warp status determination unit 8 determine that the warp shape is a positive-posture S-shaped warp in a case where both the left straight lines and the right straight lines rise to the right, and determine that the warp shape is a reverse-posture S-shaped warp in a case where both the left straight lines and the right straight lines fall to the right.

Addtionally, the warp status determination unit 8 determines that the warp shape is a positive-posture M-shaped warp, in a case where the inclinations of the left straight lines rise to the night, the displacement values (central measurement values) of the measurement points P5 and P6 are larger than the average displacement value d* (in other words, the central part heights are lower than the average height), and the inclinations of the right straight lines fall to the right, and conversely, determines that the warp shape is a reverse-posture M-shaped warp, in a case where the inclinations of the left straight lines fall to the right, the displacement values of the measurement point. P5 and of P6 are smaller than the average displacement value d* (in other words, the central part heights are higher than the average height), and the inclinations of the right straight lines rise to the right.

In addition, the warp shape may be determined to be the positive-posture M-shaped warp in a case where the left straight lines rise to the right, one of the displacement values of the measurement points P5 and P6 is larger than the average displacement value d* and the other of the displacement values of the measurement points P5 and P6 is smaller than the average displacement value d*, and the right straight lines fall to the right. Similarly, the warp shape may be determined to be the reverse-posture M-shaped warp in a case where the left straight lines fall to the right, one of the displacement values of the measurement points P5 and P6 is larger than the average displacement value d* and the other of the displacement values of the measurement points P5 and P6 is smaller than the average displacement value d*, and the right straight lines rise to the right.

The warp status determination unit 8 obtains the warp shapes of the respective shingling status corrugated fiberboards 24Ca, 24*cb*, and 24Cc, respectively, in this way, and determines the shapes of the produced sheet width warp according to the combinations of the warp shapes of these respective shingling status corrugated fiberboard 24Ca, 24*cb*, and 24Cc. The shapes of the produced sheet width warp are determined as illustrated in FIG. 9, for example, depending on the combinations of the upward warp and the downward warp.

In detail, the warp status determination unit 8 determines the produced sheet width warp to be the upward warp in a case where the respective shingling status corrugated fiberboards 24Ca, 24Cb, and 24Cc are all determined to have the upward warp, and determines the produced sheet width warp to be the downward warp in a case where the respective shingling status corrugated fiberboards 24Ca, 24Cb, and 24Cc are all determined to have the downward warp.

Additionally, the warp status determination unit 8 determines the produced sheet width warp to be the positive-posture S-shaped warp in a case where the shingling status corrugated fiberboard 24Ca is determined to have the downward warp, the shingling status corrugated fiberboard 24Cb is determined to have the reverse-posture S-shaped warp or the like and the shingling status corrugated fiberboard 24Cc is determined to have the upward warp, and conversely, determines the produced sheet width warp to be the reverse-posture S-shaped warp in a case where the shingling status corrugated fiberboard 24Ca is determined to have the upward warp, the shingling status corrugated fiberboard 24Cb is determined to have the positive-posture S-shaped warp and the shingling status corrugated fiberboard 24Cc is determined to have the downward warp.

Additionally, the warp status determination unit 8 determines the produced sheet width warp to be the reverse-posture M-shaped warp in a case where the shingling status corrugated fiberboards 24Ca and 24Cc at both ends are determined to have the downward warp and the central shingling status corrugated fiberboard 24Cb is determined to have the upward warp, and conversely, determines the produced sheet width warp to be the positive-posture M-shaped warp in a case where the shingling status corrugated fiberboard 24Ca and 24Cc at both ends are determined to have the upward warp and the central shingling status corrugated fiberboard 24Cb is determined to have the downward warp.

[1-4-2. Determination of Warp Amount]

Although the warp status determination unit 8 finally determines the produced sheet width warp shape regarding the warp shape, the warp status determination unit 8 determines the warp amount per one shingling status corrugated fiberboard 24C (that is, when the warp is corrected, the produced sheet width warp shape is used regarding the warp shape, and the warp amount per one shingling status corrugated fiberboard 24C is used for the warp amount or a warp factor) regarding the warp amount.

A warp amount determination method by the warp status determination unit 8 will be described with reference to FIG. 10.

Figure 10:
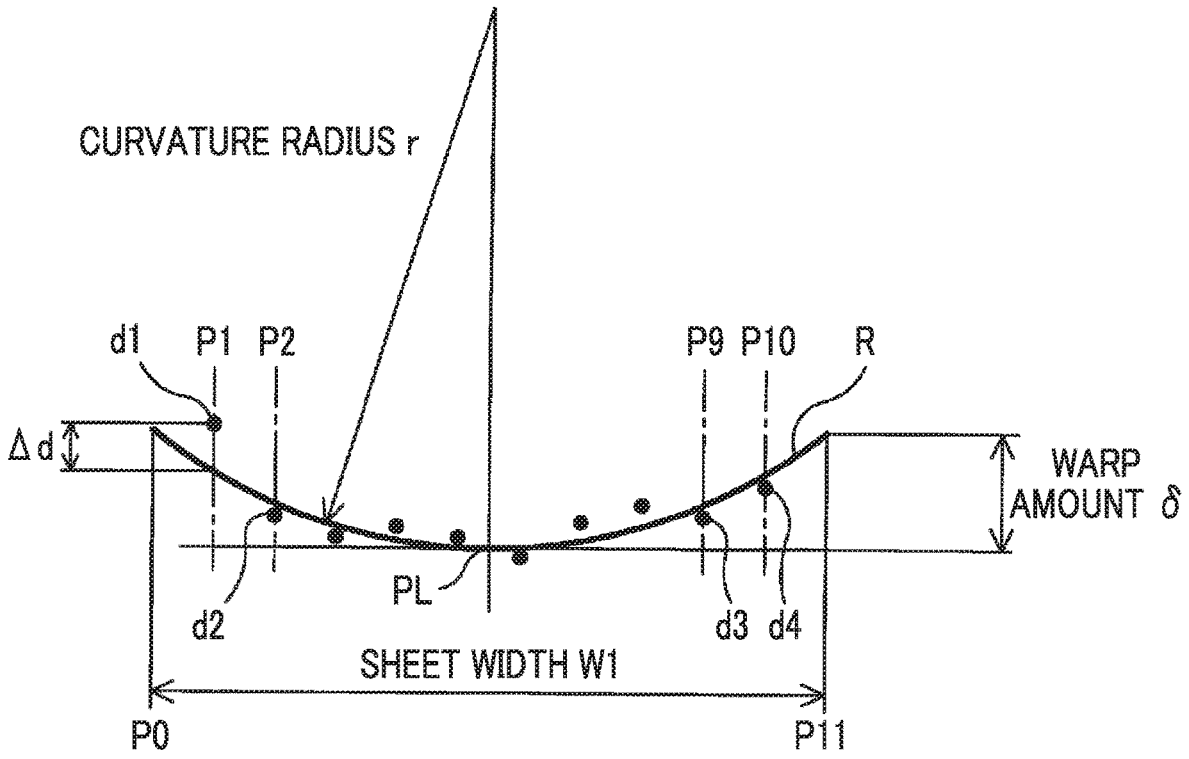
FIG. 10 is a schematic view for explaining a warp amount determination method related to the first embodiment of the invention, and is a front view of a shingling status corrugated fiberboard.

FIG. 10 is a schematic view for explaining the warp amount determination method related to the first embodiment of the invention, and is a front view of a shingling status corrugated fiberboard.

In a case where the warp shapes of the shingling status corrugated fiberboards 24C are the upward warp or the downward warp, the warp shape of each shingling status corrugated fiberboard 24C is approximated to a circular-arc shape R, as illustrated in FIG. 10. Then, on the basis of a radius (curvature radius) r of the circular-arc shape R and the slit width W1 acquired from the production management system, a warp amount δ is calculated by the following Equation (1). Moreover, on the basis of the warp amount δ and the slit width W1, a warp factor WF is calculated by the following Equation (2).

The approximation of the warp shape to the circular-arc shape can be obtained using the well-known least square method from the average value of the measurement values of the shingling status corrugated fiberboard 24C at the respective measurement points P1 to P10 obtained on the basis of the measurement values of the displacement sensors 7.

$$\delta = r - \sqrt{r^2 - (W1/2)^2} \tag{1}$$

$$WF = \frac{\delta \times 610^2}{W1^2 \times 25.4} \tag{2}$$

The warp status determination unit 8 obtains warp amounts zΔ and warp factors WF by the above Equations (1) and (2) regarding the respectively shingling status corrugated fiberboards 24Ca, 24Cb, and 24Cc, respectively. An average value of the respective warp amounts Δ of shingling status corrugated fiberboards 24Ca, 24Cb, and 24Cc and an average value of the warp factors WF are adopted as a final (used for warp correction) warp amount. δ and a final warp factor WF.

The reason why the measurement values of the displacement sensors 7 are approximated to the circular arc R in this way is based on the following reason.

For example, in FIG. 10, the warp amount of the shingling status corrugated fiberboard 24 in the sheet width direction W is a difference between the lowest position appearing at a center PL in the sheet width direction and a highest position appearing in the vicinity of both ends P0 and P11 in the sheet width direction. However, the measurement points P1 and P10 nearest to end parts among the measurement points of the respective displacement sensors 7 do not coincide with both the ends P0 and P11 in the sheet width direction in many cases, as illustrated in FIG. 10. In a case where the measurement value of at least one of the measurement points P1 and P10 nearest to the end parts, that is, with the largest warp amount is not used particularly due to the shingling as will be described below, the warp amounts Δ and the warp factors WF may be calculated to be smaller than actual values on the basis of the measurement values of P2 and P9 having smaller warp amounts than the measurement points P1 and P10.

For this reason, tor example, even in a case where the measurement values of the measurement points P1 and P10 are not adopted, the warp shape is approximated to the circular-arc curve R from the measurement values of P2 to P9, and displacement values at the end parts P0 and P11 in the sheet width direction on this circular-arc curve R are determined as the warp amounts Δ.

Additionally, for example, in a case where the measurement points P1 is less than a predetermined distance from a creasing line position and a difference Δd between a measurement value d1 of the displacement sensor 7 and the circular-arc curve R at the measurement points P1 exceeds a first predetermined value, the measurement value is regarded to be greatly influenced by the creasing line, and the warp status determination unit 8 recalculates the circular-arc curve R except for the measurement value d1. The creasing line position can be acquired from the production management system.

Moreover, in a case where there is a displacement sensor 7 in which the difference between the measurement value and the circular-arc curve R becomes greater than a second predetermined value greater than the first predetermined value, the repeatability by the circular-arc curve R may be regarded to be low and an error display may be output to the output device 9.

In a case where the warp shape of the shingling status corrugated fiberboard 24C is other than other than the upward warp or the downward warp, the warp amount δ is calculated as a difference between a maximum displacement value and a minimum displacement value in the measurement values of the displacement value sensors 7 allocated to the shingling status corrugated fiberboard 24C.

[1-4-3. Consideration for Shingling and the Like]

Figure 11A:
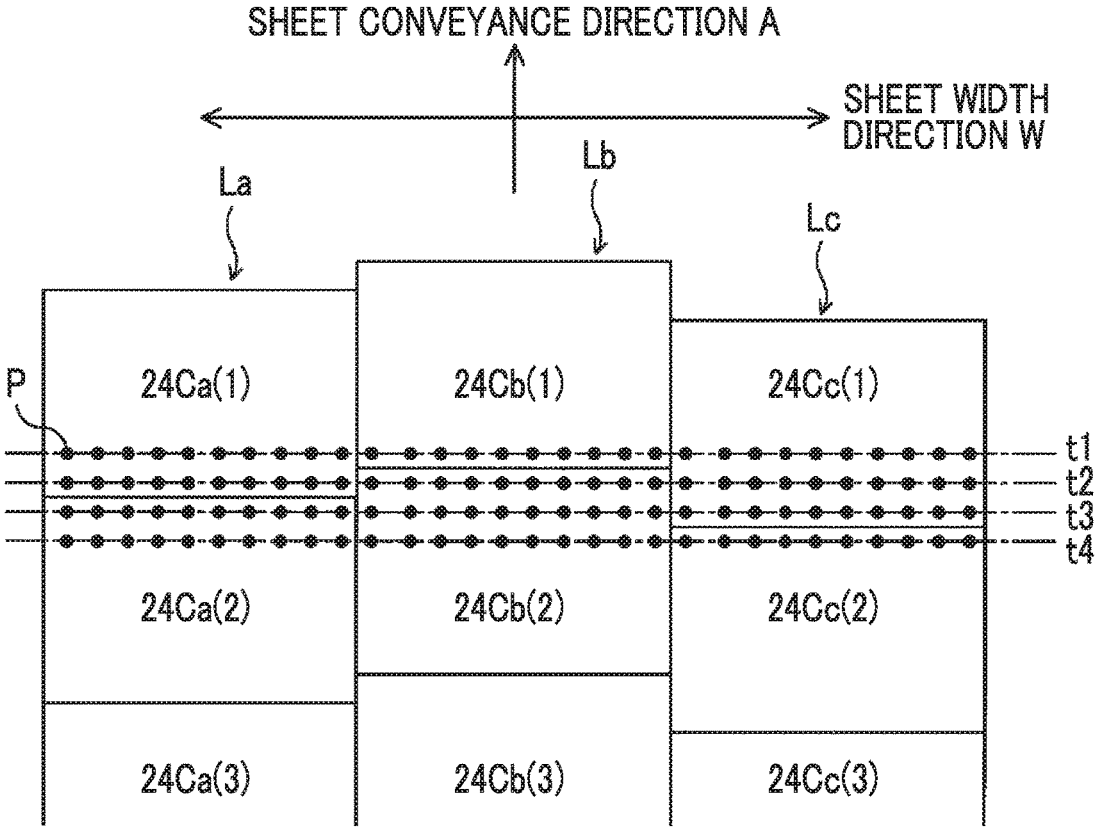
FIGS. 11A and 11B are schematic views for explaining a warp status determination method, in which shingling is taken into consideration, related to the first embodiment of the invention.
Figure 11B:
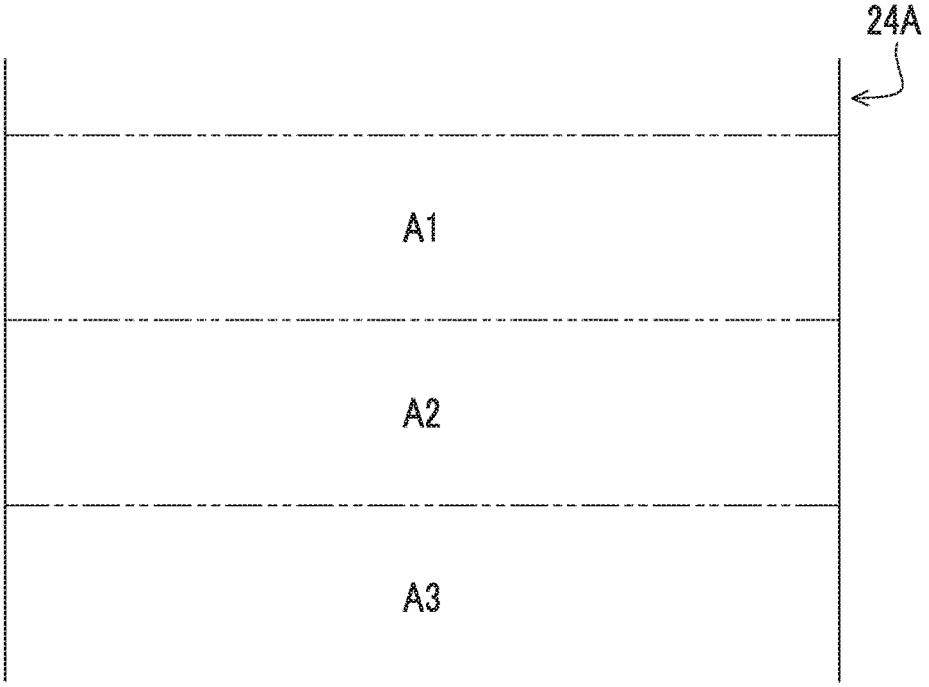

Control in which the shingling is taken into consideration will be described with reference to FIG. 11. FIGS. 11A and 11B are schematic views for explaining a warp status determination method, in which the shingling is taken into consideration, related to the first embodiment of the invention, FIG. 11A is a plan view illustrating the shingling status corrugated fiberboards conveyed on the stacker conveyor, and FIG. 11B is a plan view illustrating a corrugated fiberboard web before being longitudinally cut.

The same numbers within parentheses in FIG. 11A indicate that the corrugated fiberboards have leading edges transversely cut simultaneously by a cutoff 18. That is, shingling status corrugated fiberboards 24Ca(1), 24Cb(1), and 24Cc(1) have leading edges transversely cut simultaneously by the cutoff 18, the shingling status corrugated fiberboards 24Ca(2), 24Cb(2), and 24Cc(2) have leading edges transversely cut simultaneously by the cutoff 18, and shingling status corrugated fiberboards 24Ca(3), 24Cb(3), and 24Cc(3) have leading edges transversely cut simultaneously by the cutoff 18.

Additionally, the shingling status corrugated fiberboards 24Ca(1), 24Ca(2), and 24Ca(3) that makes a row in the sheet conveyance direction A are shingled, and similarly, the shingling status corrugated fiberboard 24Cb(1), 24Cb(2), and 24Cb(3), and the shingling status corrugated fiberboard 24Cc(1), 24Cc(2), and 24Cc (3) are shingled. That is, since the shingling is performed by stacking leading and trailing shingling status corrugated fiberboards with respect to the sheet conveyance direction each shingling occurs for each of a sheet row La including the shingling status corrugated fiberboards 24Ca, a sheet row Lb including the shingling status corrugated fiberboards 24Cb, and a sheet row Lc including the shingling status corrugated fiberboards 24Cc.

Here, since the shingling status corrugated fiberboards 24Ca(1), 24Cb(1), and 24Cc (1) has the leading edges transversely cut simultaneously by the cutoff 18, the leading edges are aligned at the time this transverse cutting. In other words, the shingling status corrugated fiberboards 24Ca(1), 24Cb(1), and 24Cc(1) form a region A1 in the sheet width direction W in the corrugated fiberboard web 24A as illustrated in FIG. 11B before the longitudinal cutting by the slitter scorer 17 and the transverse cutting by the cutoff 18 are performed. Similarly, before the longitudinal cutting by the slitter scorer 17 and the transverse cutting by the cutoff 18 are performed, the shingling status corrugated fiberboards 24Ca(2), 24Cb(2), and 24Cc(2) form a region A2 in the sheet width direction W in the corrugated fiberboard web 24A, and the shingling status corrugated fiberboards 24Ca (3), 24Cb(3), and 24Cc(3) form a region A3 in the sheet width direction W in the corrugated fiberboard web 24A.

Since the shingling occurring on the stacker conveyor 191B occurs for each of the sheet row La, the sheet row Lb, and the sheet row Lc, the occurrence condition of the shingling also differ for each of the sheet row La, the sheet row Lb, and the sheet row Lc. For this reason, the shingling status corrugated fiberboards 24Ca, 24Cb, and 24Cc that form the sheet row La, the sheet row Lb, and the sheet row Lc are conveyed on the stacker conveyor 191B in a state where the leading edge positions thereof are shifted. That is, the shingling status corrugated fiberboard 24Ca(1), 24Cb(1), and 24Cc(1) that form the region A1 in the corrugated fiberboard web 24A such that the leading edge positions thereof are aligned as illustrated in FIG. 11B, the leading edges are not aligned (are shifted with respect to the sheet conveyance direction A) on the stacker conveyor 191B as illustrated in FIG. 11A. The leading edges of the shingling status corrugated fiberboards 24Ca(2), 24Cb(2), and 24Cc (2) and the shingling status corrugated fiberboards 24Ca(3), 24Cb(3), and 24Cc(3) are not also similarly aligned on the stacker conveyor 191B as illustrated in FIG. 11A.

For this reason, in the example illustrated in FIG. 11A, the measurement points P of the displacement sensors 7 at a measurement time t3 straddle the shingling status corrugated fiberboards 24Ca(2) and 24Cb(2) and the shingling status corrugated fiberboard 24Cc(1). For this reason, in order to determine the respective warp shapes of the shingling status corrugated fiberboards 24Ca(2), 24Cb(2), and 24Cc(2) on the basis of the measurement values of the displacement sensors 7, and further determine the produced sheet width warp shape, in other words, the warp shape of the region A2 from these warp shapes, it is necessary to perform measurement of the shingling status corrugated fiberboard 24Cc(2) corresponding to the region A2 from a measurement time t4 after the measurement of the shingling status corrugated fiberboard 24Cc (1) is completed at the measurement time t3.

Thus, in the invention, in a shingled state, a leading edge of an upstream shingling status corrugated fiberboard 24C rides on a downstream shingling status corrugated fiberboard 24C. Therefore, when a measurement object for the displacement sensors 7 is switched from the downstream shingling status corrugated fiberboard 24C to the upstream shingling status corrugated fiberboard 24C, the measurement values or the respective displacement sensors 7 that increase stepwise by a sheet thickness are utilized.

That is, when the measurement values of the displacement sensors 7 exceed a threshold value set corresponding to the sheet thickness compared to measurement values in a measurement cycle (hereinafter simply referred to as a cycle) of a previous shingling status corrugated fiberboard 24C, the measurement of the displacement sensors 7 is regarded to be switched from the downstream shingling status corrugated fiberboard 24C to the upstream shingling status corrugated fiberboard 24C, and measurement of the displacement values of the respective shingling status corrugated fiberboards 24Ca, 24Cb, and 24Cc is performed with the timing when exceeding the threshold value as a reference.

Specifically, in the example illustrated in FIG. 11A, when the measurement time of the displacement sensors 7 is switched from t1 to t2, the measurement object for the displacement sensors 7 is switched from the shingling status corrugated fiberboard 24Cb(1) to the shingling status corrugated fiberboard 24Cb(2) and the measurement values of the displacement sensors 7 vary over the threshold value. Thus, the warp shape of the shingling status corrugated fiberboard 24Cb(2) is determined on the basis of measurement values at this measurement time t2 or measurement values after elapse of a predetermined measurement interval (or after elapse of a predetermined time) from this measurement time t2.

Additionally, when the measurement time of the displacement sensors 7 switched from t2 to t3, the measurement object for the displacement sensors 7 is switched from the shingling status corrugated fiberboard 24Ca(1) to the shingling status corrugated fiberboard 24Ca(2) and the measurement values of the displacement sensors 7 vary over the threshold value. Thus, the warp shape of the shingling status corrugated fiberboard 24Ca(2) is determined on the basis of measurement values at this measurement time t3 or measurement values after elapse of a predetermined measurement interval (or after elapse of a predetermined time) from this measurement time t3.

Additionally, when the measurement time of the displacement sensors 7 is switched from t3 to t4, the measurement object for the displacement sensors 7 is switched from the shingling status corrugated fiberboard 24Cc(1) to the shingling status corrugated fiberboard 24Cc(2) and the measurement values of the displacement sensors 7 vary over the threshold value. Thus, the warp shape of the shingling status corrugated fiberboard 24Cc(2) is determined on the basis of measurement values at this measurement time t4 or measurement values after elapse of a predetermined measurement interval (or after elapse of a predetermined time) from this measurement time t4.

In this way, measurement timings are separately set regarding the respective shingling status corrugated fiberboards 24Ca, 24Cb, and 24Cc. Thus, even if the respective shingling status corrugated fiberboards 24Ca, 24Cb, and 24Cc are shifted in the sheet conveyance direction, this shift can be offset, the warp shapes can be determined with respect to the shingling status corrugated fiberboards 24Ca, 24Cb, and 24Cc tht form the same region of the corrugated fiberboard web 24, and therefore the produced sheet width warp of the region can be determined precisely.

Figure 12:
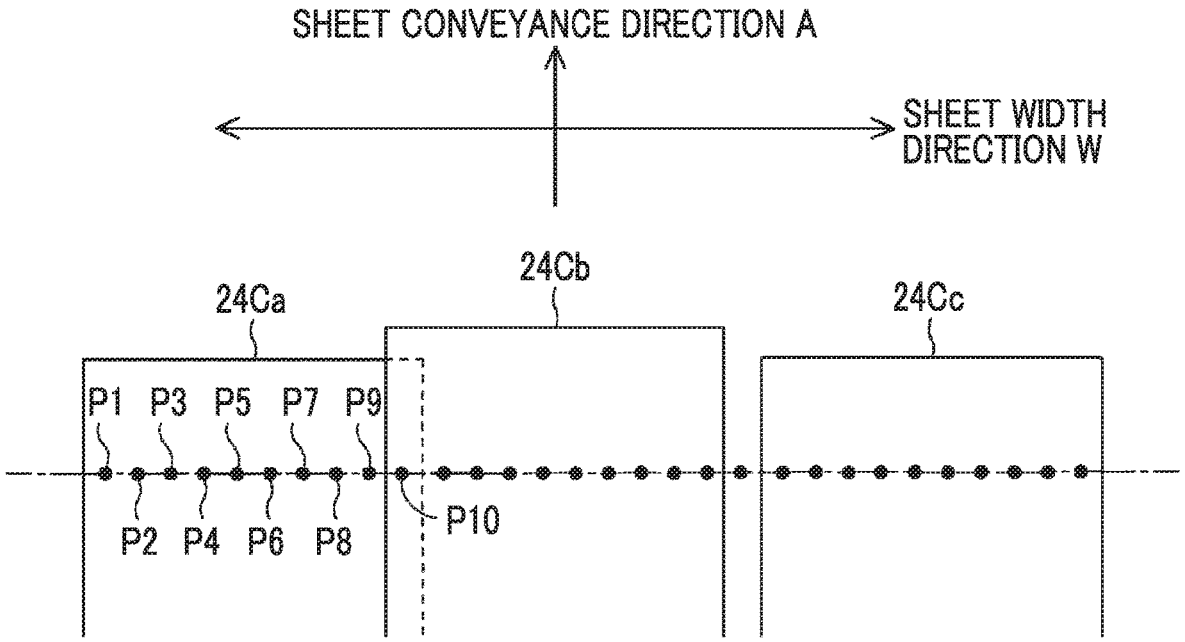
FIG. 12 is a schematic view for explaining the warp status determination method related to the first embodiment of the invention, and is a plan view illustrating the shingling status corrugated fiberboards conveyed on the stacker conveyor.

Additionally, the shingling status corrugated fiberboards 24C after the longitudinal cutting by the slitter scorer 17 may shift with respect to the sheet width direction W. For this reason, if the shingling status corrugated fiberboard 24Cb shifted to the shingling status corrugated fiberboard 24Ca side so as to ride thereon as illustrated in FIG. 12 even if the displacement sensors 7 are allocated to the respective shingling status corrugated fiberboards 24C, measurement at the measurement point P10 to be originally measured regarding the shingling status corrugated fiberboard 24Ca is performed on the shingling status corrugated fiberboard 24Cb. This may become the noise of determination of the warp shape or warp amount of the shingling status corrugated fiberboard 24Ca.

Thus, in a case where a measurement point (in FIG. 12, for example, the measurement point P10) nearest to a width-direction end part (an end part in the sheet width direction W) of the shingling status corrugated fiberboard 24C is within a predetermined distance range (for example, less than 5 mm) from a longitudinal cutting position (a position where the longitudinal cutting is performed) of the slitter scorer 17, the warp status determination unit 8 does not use the measurement value of a displacement sensor 7, which measures this measurement point, for the warp status determination.

Alternatively, in the displacement sensors 7 that measure the measurement points P1 to P10 allocated to the shingling status corrugated fiberboard 24Ca, in a case where the measurement value of a specific displacement sensor 7 (the displacement sensor 7 that measures the measurement point P10 in the example illustrated in FIG. 12) exceeds an average value (representative value) of the measurement values of the other displacement sensors (displacement sensors 7 that measure the measurement points P1 to P9 in the example illustrated in FIG. 12) by the thickness of the shingling status corrugated fiberboard 24C, the warp status determination unit 8 may not use the measurement value of this specific displacement sensor 7 for the warp status determination.

In addition, by slidably fixing the displacement sensors 7 to the frame 71 (refer to FIG. 5) and providing driving means, the displacement sensors 7 that are within the predetermined distance range (for example, less than 5 mm) from the longitudinal cutting position (the position where the longitudinal cutting is performed) of the slitter scorer 17 can be positionally adjusted at a preset normal position so as to deviate from the predetermined distance range. Accordingly, the warp shapes of the shingling status corrugated fiberboards 24C and the warp shape of the corrugated fiberboard web 24A can be precisely detected on the basis of the measurement values of all the displacement sensors 7.

[1-5. Function and Effect)

According to the warp determination device for a corrugated fiberboard manufacturing device, the warp correction device for a corrugated fiberboard manufacturing device, and a corrugated cardboard manufacturing system in the first embodiment of the invention, the plurality of displacement sensors 7 arranged in the sheet width direction W are allocated to the shingling status corrugated fiberboards 24C, respectively, according to the respective slit widths W1 of the shingling status corrugated fiberboards disposed side by side in the sheet width direction W. Then, the warp statuses (the warp shapes and the warp amounts) of the respective shingling status corrugated fiberboards 24C are determined on the basis of the measurement values of the allocated displacement sensors 7.

Hence, the warp statuses of the respective shingling status corrugated fiberboards 24C can be determined in a state where the respective shingling status corrugated fiberboards 24C approach the moisture equilibrium state past the double facer 16 downstream of the slitter scorer 17 and upstream of the stacking unit 192. Accordingly, the warp statuses can be determined in a corrugated fiberboard production completed state (finished state), and the warp correction can be precisely performed on the basis of this.

Moreover, since the warp determination is performed on the shingling status corrugated fiberboards 24C upstream of the stacking unit 192, it is possible to perform a feedback at an earlier stage than to feed back the warp statuses of the shingling status corrugated fiberboards 24C stacked on the stacking unit 192 on the most downstream side of the stacker 19 to the warp correction.

Hence, the warp statuses of the corrugated fiberboards can be determined in the corrugated fiberboard production completed state (finished state) and at an early stage, and the correction of the warp can performed precisely and at an early stage on the basis of this determination.

The warp of the shingling status corrugated fiberboards 24Ca, 24Cb, and 24Cc is caused due to the imbalance (the imbalance of the moisture content) of heating of the sheets 20, 21, 22, and 23 is the manufacturing step before the longitudinal cutting by the slitter scorer 17. The influence of this imbalance is embodied is the most intelligible form as the produced sheet width warp shape of the corrugated fiberboard web 24A before the longitudinal cutting.

According to the present embodiment, the warp status determination unit 8 determines a warp shape when it is assumed that the longitudinal cutting by the slitter scorer 17 is not performed (that is, the produced sheet width warp shape of the corrugated fiberboard web 24A before the longitudinal cutting), on the basis of the respective warp statuses in the plurality of shingling status corrugated fiberboards 24Ca, 24Cb, and 24Cc, and the arrangement of the plurality of shingling status corrugated fiberboard 24Ca, 24Cb, and 24Cc.

Hence, the correction of the warp can be more precisely performed by controlling the control elements that influence the warp of the corrugated fiberboard manufacturing device 1 on the basis of the produced sheet width warp shape in which the influence of the balance of heating (content moisture) of the sheets 20, 21, 22, 23 is embodied directly.

Moreover, since the displacement sensors 7 perform measurement on the corrugated fiberboard one box outs 24 in the midst of being transversely cut by the cutoff and being conveyed by the stacker conveyor, and the warp statuses are determined on the basis of the measurement results, the warp statuses in a state nearer to an end-product state can be determined.

Although the respective measurements by the plurality of displacement sensors 7 are performed on the shingling status corrugated fiberboards 24Ca, 24Cb, and 24Cc in a shingled state on the stacker conveyor 191B, the leading edge positions of the shingling status corrugated fiberboards 24Ca, 24Cb, and 24Cc becomes irregular in the shingled state.

The warp status determination unit 8 performs selection of the measurement values of the displacement sensors 7 used for determining the warp statuses of the respective shingling status corrugated fiberboards 24Ca, 24Cb, and 24Cc on the stacker conveyor 191B. This selection is performed on the basis of a cycle in which the variations of the measurement values of the displacement sensors 7 with respect to the measurement values in the previous cycle exceed the threshold value set according to the thickness of the shingling status corrugated fiberboards 24Ca, 24Cb, and 24Cc for the respective shingling status corrugated fiberboards 24Ca, 24Cb, and 24Cc. That is, in a case where the variations of the measurement values of the displacement sensors 7 with respect to the measurement values in the previous cycle exceed the threshold value, the measurement object of the displacement sensors 7 is determined to have moved from the upstream shingling status corrugated fiberboard 24Ca, 24Cb, and 24Cc to the downstream shingling status corrugated fiberboard 24Ca, 24Cb, and 24Cc of which the leading edges ride on the upstream shingling status corrugated fiberboard 24Ca, 24Cb, and 24Cc, and the measurement cycles (and therefore measurement regions) of the downstream shingling status corrugated fiberboards 24Ca, 24Cb, and 24Cc are individually set with this timing as a reference. Hence, even in the shingled state, the measurement and therefore the determination of the warp shapes can be precisely performed by the displacement sensors 7, without being influenced by the irregularity of the leading edge positions of the shingling status corrugated fiberboards 24Ca 24Cb, and 24Cc.

In a case where piece cutting is performed by the slitter scorer 17 with the same slit width, the warp status determination unit 8 obtains the slit width W1 of the respective shingling status corrugated fiberboards 24C on the basis of the width dimension (produced sheet width) Wt and piece number of the corrugated fiberboard web 24A acquired from the production management system, and acquires different slit widths of the respective shingling status corrugated fiberboards 24Ca, 24Cb, and 24Cc from the production management system in a case where piece cutting is performed with the different slit widths by the slitter scorer 17. The warp status determination unit 8 can easily determine the displacement sensors 7 allocated to the respective shingling status corrugated fiberboards 24C, respectively, using the slit widths.

In a case where a shingling status corrugated fiberboard 24C next to the shingling status corrugated fiberboard 24C that is the measurement object deviates from a regular conveyance route and rides on the shingling status corrugated fiberboard 24C that is the measurement object, there is a concern that the displacement sensors 7 may measure not the shingling status corrugated fiberboard 24C that is the measurement object but the riding shingling status corrugated fiberboard 24C.

Additionally, In a case where the shingling status corrugated fiberboard 24C that is the measurement object deviates from the regular conveyance route, there is a concern that the displacement sensors 7 will measure points (for example, an upper surface of the stacker conveyor 191B) where the shingling status corrugated fiberboard 24C that is the measurement object is not located.

Since the possibility that the shingling status corrugated fiberboard 24C that is an original measurement object is not measured is high at the time of such trouble, the warp status determination unit 8 of the present embodiment does not use the detection results of the displacement sensors 7, which are within a predetermined distance from an end part of the shingling status corrugated fiberboard 24C, for determining of the warp statuses.

In addition, in a case where measurement has been performed on the shingling status corrugated fiberboard 24C that has ridden on the shingling status corrugated fiberboards 24C that is the measurement object, the measurement values thereof become values that are different by thickness from normal measurement values (measurement values for the shingling status corrugated fiberboard 24C that is the measurement object). The warp status determination unit 8 of the present embodiment does not use measurement values, which deviate from the average value (representative value) among the measurement values of the displacement sensors 7 of a group allocated to the shingling status corrugated fiberboard 24C that is the measurement object, for determination of the warp statuses. Hence, even in a case where the trouble that the shingling status corrugated fiberboard 24C that is the measurement object or its next shingling status corrugated fiberboard 24C deviates from the regular conveyance route has occurred, the warp statuses can be precisely determined, using only the normal measurement values (measurement values regarding the shingling status corrugated fiberboard 24C that is the measurement object).

When a warp shape is the upward warp or the downward warp, the warp amount, of the shingling status corrugated fiberboard 24C becomes maximum at both ends of the sheet.

However, since a displacement sensor 7 is within the predetermined distance from an end part of the shingling status corrugated fiberboard 24C, a warp amount near the end part cannot be detected in a case where the detection result of this displacement sensor 7 is not used for determination of the warp shape. Thus, when a warp shape is the upward warp or the downward warp, the warp status determination unit 8 of the present embodiment approximates the warp shape to the circular-arc shape, and estimates a warp amount at the end part of the shingling status corrugated fiberboard 24C, using the curvature radius and the slit width W1 of this circular-arc shape. Hence, the warp amount can be determined precisely.

Since the specific control element related to the generation of the warp shape is selected and controlled out of the control elements of the corrugated fiberboard manufacturing device 1 on the basis of the produced sheet width warp shape determined by the warp status determination unit 8, the warp occurring in the corrugated fiberboard manufacturing device 1 can be corrected efficiently.

In a case where the sheet temperature measuring means for measure sheet temperature regarding at least one of the medium 21, the top liner 20, the single-faced corrugated board 22, the bottom liner 23, and the corrugated fiberboard web 24A, the process controller 5 sets the control amount of the specific control element, within a range in which the sheet temperature measured by the sheet temperature measuring means does not fall below than the lower limit temperature set on the basis of the gelation temperature of the glue used for the bonding. The warp correction can be performed in a range in which poor bonding does not occur.

Since at least one of the warp status information and the produced sheet width warp status information of the shingling status corrugated fiberboards 24C determined by the warp status determination unit 8 is displayed from the output device 9, such as a display device or a printing device, depending on at least one of the character information and the image information, an operator tends to ascertain the warp statuses or the produced sheet width warp status.

Since the operational status of a control element (specific control element) highly related to the warp (produced sheet width warp) of the corrugated fiberboard web 24A at the time of the warp occurrence and after the control of the specific control element, respectively, is stored in the operational status storage unit 5A, a mechanism of the warp occurrence or how the warp is corrected can be analyzed.

If the warp status determination unit 8 determines that a warp amount is equal to or smaller than predetermined value, the control elements, such as the double facer speed and the single-faced corrugated board preheater winding amount in the single-faced corrugated board preheater 13, are preset as the above optimal operational statuses, respectively, by the teaching control, in a case where the operational status in this case is stored as the optimal operational status corresponding to the current order and thereafter the operation by the same order is performed. Thus, the warp can be precisely and east suppressed without depending on an operator's experience or know-how.

In the feedback control in which the warp statuses actually generated in the shingling status corrugated fiberboards 24C are determined and the warp is corrected on the basis of this, in the case of a short order (in a case where the order of the corrugated fiberboards is switched in a short period of time), there is a concern that the liners 20 and 23 related to the short order may pass through devices (the single-faced corrugated board preheater 13, the bottom liner preheater 14, and the top liner preheater 10 in this case) for correcting the warp, and cannot suppress the warp, rather than performing this feedback control. However, according to this system, even in the short order, the order is switched and the order of the corrugated fiberboard manufacturing device 1 is switched, and simultaneously the specific control element is controlled to be the above optimal operational statuses. Thus, there is an advantage that the warp can be suppressed.

Since the detection of the warp statuses can be previously detected as described above and the detected warp statuses can be fed back at an early stage, corrugated fiberboards that do not have warp can be manufactured stably.

2. Second Embodiment

Figure 13:
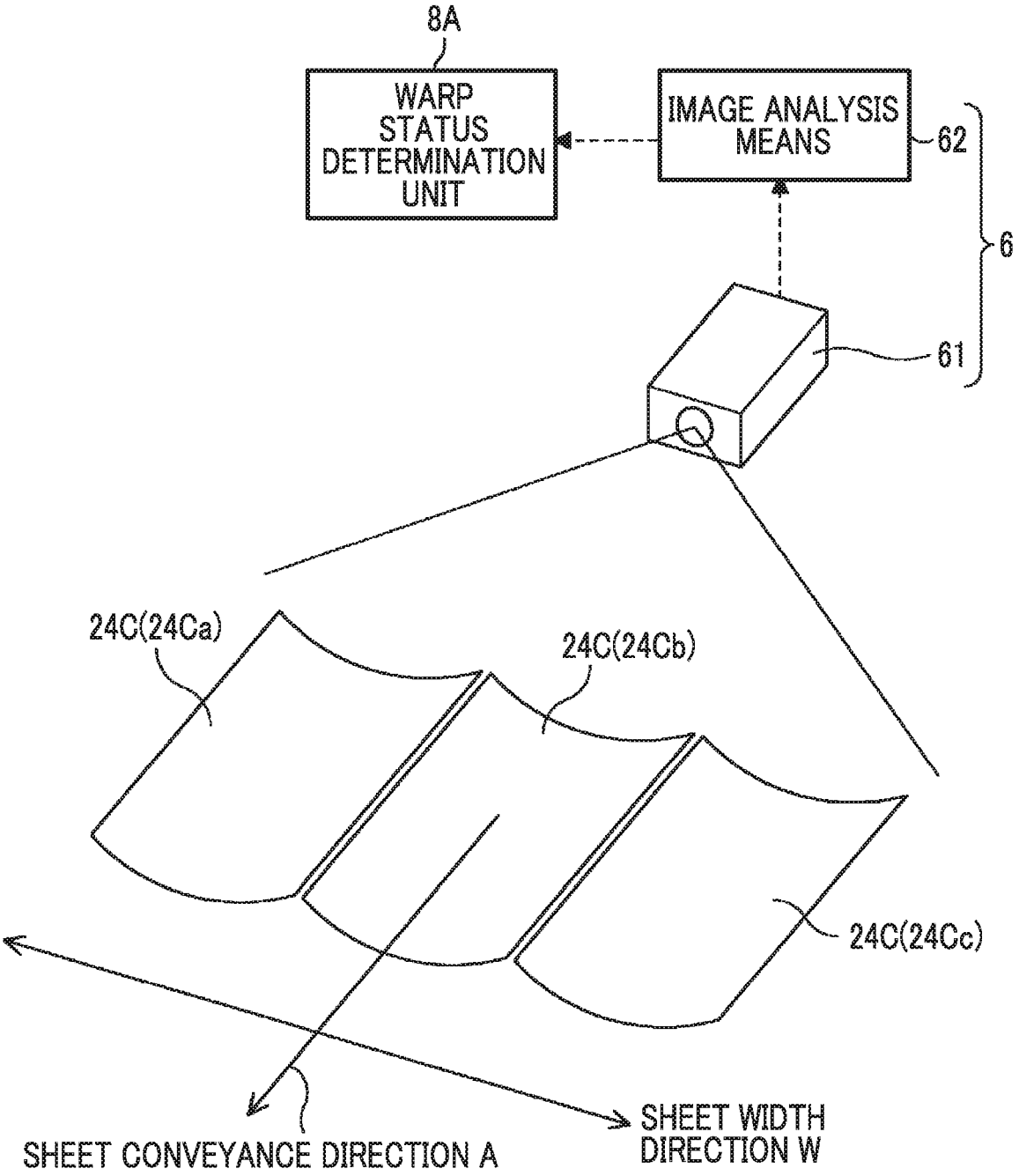
FIG. 13 is a schematic view illustrating the configuration of a warp determination device of a second embodiment of the invention.
Figure 14A:
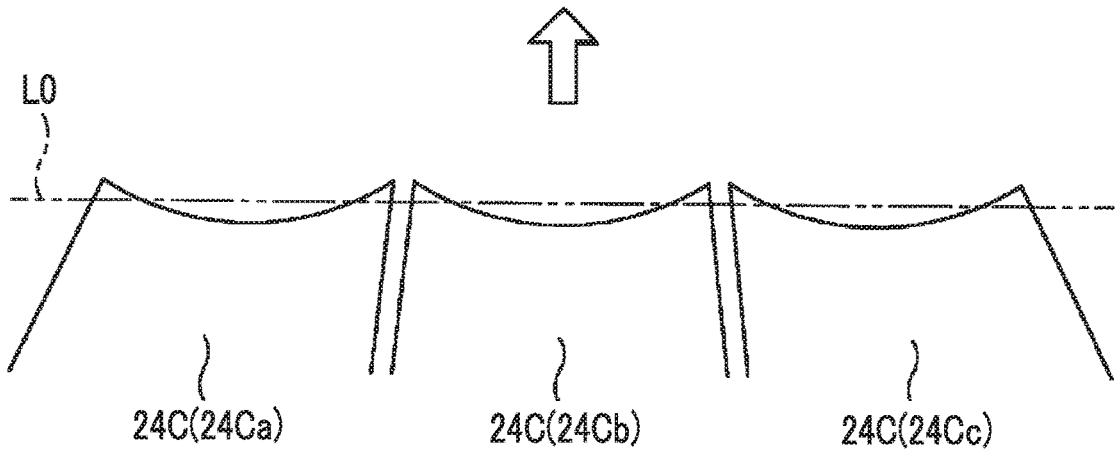
FIGS. 14A and 14B are schematic views for explaining measurement of the displacement value and a warp determination method in the second embodiment of the invention.
Figure 14B:
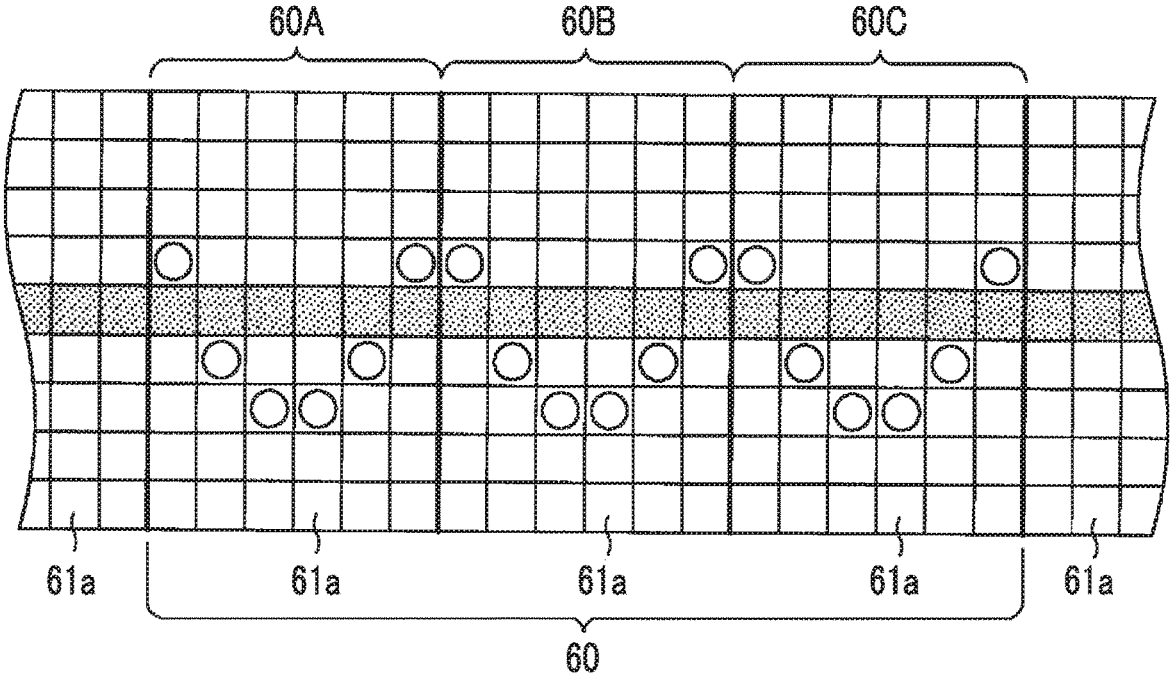

FIG. 13 is a schematic view illustrating the configuration of the warp determination device of the second embodiment of the invention. FIGS. 14A and 14B are schematic views for explaining measurement of the displacement value and a warp determination method in the second embodiment of the invention, FIG. 14A is a view illustrating an example of an image (acquired image information) captured by an area sensor, and FIG. 14B is a view illustrating an example of displacement value information on the corrugated fiberboards obtained from the image information of FIG. 14A.

Similar to the warp determination device of a first embodiment, a warp determination device of the present embodiment is provided in the corrugated fiberboard manufacturing device includes, and constitutes the warp correction device. The warp determination device of the above first embodiment configured to include the displacement value measurement method including the plurality of displacement sensors 7, and the warp status determination unit 8. In contrast, as illustrated in FIG. 13, the warp determination device of the present embodiment is configured to include displacement value measurement method 6 having an area sensor (imaging means) 61 and image analysis means 62, and a warp status determination unit 8A. In addition, in FIG. 13, the stacker 19, and shingling status corrugated fiberboards 24C that are shingled upstream of and downstream of the illustrated shingling status corrugated fiberboards 24C are omitted for the sake of convenience.

The area sensor 61 images the plurality of shingling status corrugated fiberboards 24Ca, 24Cb, and 24Cc (here, three sheets having the same width dimension) in the midst of being conveyed by the stacker conveyor 191B (refer to FIG. 5) from the upstream side, and has an imaging range (pixel number) that covers the maximum sheet width dimension Wmax (refer to FIG. 6).

FIG. 14A illustrates an example of an image of the shingling status corrugated fiberboard 24Ca, 24Cb, and 24Cc captured by the area sensor 61. Such an image (image information) is repeatedly output, to the image analysis means 62 at every predetermined measurement interval Δt. Whenever outputs are received from the area sensor 61, (that is, at every predetermined measurement interval Δt), the image analysis means 62 analyzes displacement values in conveyance-direction end surfaces (end surfaces directed to the sheet conveyance direction A) of the shingling status corrugated fiberboards 24Ca, 24Cb, and 24Cc from this image information to output the displacement values to the warp status determination unit 8A.

The analysis by the image means 62 analyzes the image information from the area sensor 61 to specify the conveyance-direction end surfaces of the shingling status corrugated fiberboards 24Ca, 24Cb, and 24Cc, and outputs the displacement value information as illustrated in FIG. 14B to the warp status determination unit 8A, using differences between the conveyance-direction end surfaces and an imaginary horizontal reference line L0 illustrated by a two-dot chain line in FIG. 14A as the displacement values.

Respective grids illustrated in FIG. 14B indicate pixels 61*a* of the area sensor 61. Pixels to which O marks are given among these pixels are pixels 61*a* corresponding to a captured image of the conveyance-direction end surfaces of the shingling status corrugated fiberboards 24C, and solid-filled pixels 61*a* are pixels 61*a* corresponding to the horizontal reference line L0. Hence, for example, the number of pixels between the pixels 61*a* to which O marks are given, and the solid-filled pixels 61*a* is used as displacement value information on the conveyance-direction end surfaces of the shingling status corrugated fiberboards 24C.

The warp status determination unit 8A acquires the produced sheet width Wt as the order information in advance from the production management system, and selects pixels 61*a* within a suitable range 60 (here, capable of imaging the conveyance-direction end surfaces of the three shingling status corrugated fiberboards 24C) out of a range of all the pixels, for the warp status determination, on the basis of the produced sheet width Wt.

Moreover, the warp status determination unit 8A acquires the respective width dimensions W1 of the shingling status corrugated fiberboards 24Ca, 24Cb, and 24Cc as the order information from the production management system, and determines allocation ranges 60A, 60B, and 60C of the pixels in a transverse direction (a direction corresponding to the sheet width direction W), according to the ratio of the width dimension W1 per one shingling status corrugated fiberboard 24C to the produced sheet width Wt.

Also, the warp status determination unit 8A determines the warp shapes of the respective shingling status corrugated fiberboards 24Ca, 24Cb, and 24Cc from the distribution of the displacement values of the respective allocation ranges 60A, 60B, and 60C, that is, from the distribution of the displacement values of the shingling status corrugated fiberboards 24Ca, 24Cb, and 24Cc, and determines the produced sheet width warp shape, similarly to the first embodiment, from the warp shapes of the respective shingling status corrugated fiberboards 24Ca, 24Cb, and 24Cc.

In addition, FIG. 14B illustrates a small number of pixels for the sake of convenience.

Since the other configuration is the same as that of the first embodiment, the description thereof will be omitted.

Since the warp determination device of the second embodiment of the invention is configured in this way, the same effects as those of the above first embodiment are obtained.

3. Others (1) In the above respective embodiments, the displacement values of the shingling status corrugated fiberboards 24C conveyed on the stacker conveyor 191B are measured. However, the shingling status corrugated fiberboards 24C conveyed on the stacker conveyor 191A, or the displacement values of the web-shaped corrugated fiberboard one box outs 24B under conveyance between the slitter scorer 17 and the cutoff 18 may be measured.

In a case where the displacement values of the web-shaped corrugated fiberboard one box outs 24B conveyed between the slitter scorer 17 and the cutoff 18 are measured, shingling does not occur. Thus, the control related to the shingling in the determination of the warp statuses becomes unnecessary.

(2) In the above respective embodiments, an example in which the corrugated fiberboard web 24A are equally cut into pieces has been shown. However, the invention can also be applied to a case where the corrugated fiberboard web 24A is cut into a plurality of corrugated fiberboard one box outs having mutually different width dimensions.

(3) In the above respective embodiments, a case where multi-piece cutting is performed has been described. However, in a case where the piece cutting is not performed (in a case where the longitudinal cutting by the slitter scorer 17 is an unnecessary order), although natural, the information (the warp amounts and the warp shapes) on the produced sheet width warp of the corrugated fiberboard web 24A is directly determined by the warp status determination unit 8, and a various kinds of information are stored as the optimal operational status information on the basis of this determination result.

REFERENCE SIGNS LIST

1: CORRUGATED FIBERBOARD MANUFACTURING DEVICE
2: PRODUCTION MANAGEMENT DEVICE
3: KNOWLEDGE DATABASE
4: CONTROL AMOUNT CALCULATION UNIT (ORDER INFORMATION ACQUISITION MEANS)
5: PROCESS CONTROLLER (CONTROL MEANS, OPERATIONAL STATUS INFORMATION ACQUISITION MEANS)
5A: OPERATIONAL STATUS STORAGE UNIT (OPTIMAL OPERATIONAL STATUS INFORMATION STORAGE MEANS)
6: DISPLACEMENT VALUE MEASUREMENT METHOD
7: DISPLACEMENT SENSOR
7C, 7L, 7R: SENSOR GROUP
8, 8A: WARP STATUS DETERMINATION UNIT (WARP STATUS DETERMINATION MEANS)
17: SLITTER SCORER
18: CUTOFF
19: STACKER
20: TOP LINER
21: MEDIUM
22: SINGLE-FACED CORRUGATED BOARD
23: BOTTOM LINER
24A: CORRUGATED FIBERBOARD WEB
24B: CORRUGATED FIBERBOARD ONE BOX OUT
24C, 24Ca, 24Cb, 24Cc: SHINGLING STATUS CORRUGATED FIBERBOARD (CORRUGATED FIBERBOARD ONE BOX OUT)
19: STACKER
40A, 40B: TEMPERATURE SENSOR (SHEET TEMPERATURE MEASURING MEANS)
61: AREA SENSOR (IMAGING MEANS)
61*a*: PIXEL
62: IMAGE ANALYSIS MEANS
191A, 191B: STACKER CONVEYOR
192: STACKING UNIT (SHEET STACKING UNIT)
W1: WIDTH DIMENSION (SLIT WIDTH, DIMENSION IN SHEET WIDTH DIRECTION)
Wt: PRODUCED SHEET WIDTH

The invention claimed is:

1. A warp determination method for a corrugated fiberboard manufacturing device, which determines warp statuses of a plurality of corrugated fiberboard one box outs, respectively, in the corrugated fiberboard manufacturing device, the corrugated fiberboard manufacturing device longitudinally cutting a corrugated fiberboard web conveyed in a sheet conveyance direction by a slitter scorer to form a plurality of corrugated fiberboard one box outs, transversely cutting the plurality of corrugated fiberboard one box outs in a sheet width direction, respectively, by a cutoff, and then, stacking the plurality of corrugated fiberboard one box outs on a sheet stacking unit of a stacker, the warp determination method comprising:

measuring displacement values of the plurality of corrugated fiberboard one box outs downstream of the slitter scorer in the sheet conveyance direction and upstream of the sheet stacking unit in the sheet conveyance direction;

dividing a measurement range according to a width dimension that is a dimension of the plurality of corrugated fiberboard one box outs in the sheet width direction;

allocating the divided measurement ranges to the plurality of corrugated fiberboard one box outs, respectively; and determining warp statuses of the corrugated fiberboard one box outs for each of the plurality of corrugated fiberboard one box outs, on the basis of the displacement values in the allocated measurement ranges.

* * * * *